US008950457B1

(12) United States Patent
Parcels

(10) Patent No.: US 8,950,457 B1
(45) Date of Patent: Feb. 10, 2015

(54) SLIP-ON CORNER PROTECTORS FOR PICTURE FRAMES AND MACHINE AND METHOD FOR MAKING SAME

(71) Applicant: Joseph S. Parcels, Riverside, CA (US)

(72) Inventor: Joseph S. Parcels, Riverside, CA (US)

( * ) Notice: Subject to any disclaimer, the term of this patent is extended or adjusted under 35 U.S.C. 154(b) by 0 days.

(21) Appl. No.: 14/106,735

(22) Filed: Dec. 14, 2013

Related U.S. Application Data

(62) Division of application No. 13/397,664, filed on Feb. 15, 2012, now Pat. No. 8,608,887.

(51) Int. Cl.
*B65D 81/05* (2006.01)

(52) U.S. Cl.
CPC ..... *B65D 81/057* (2013.01)
USPC ..... 156/443; 156/539

(58) Field of Classification Search
CPC ..... B65D 81/05; B65D 81/057
USPC ..... 156/443, 538, 539; 493/952; 53/139.7
See application file for complete search history.

(56) References Cited

U.S. PATENT DOCUMENTS

| | | | | |
|---|---|---|---|---|
| 6,018,934 | A * | 2/2000 | Parcels | 53/472 |
| 6,418,700 | B1 * | 7/2002 | Parcels | 53/410 |
| 2003/0029552 | A1 * | 2/2003 | Parcels | 156/212 |
| 2004/0055253 | A1 * | 3/2004 | Parcels | 53/410 |

* cited by examiner

*Primary Examiner* — Philip Tucker
*Assistant Examiner* — John Blades
(74) *Attorney, Agent, or Firm* — William L. Chapin

(57) ABSTRACT

A slip-on corner protector for rectangular picture frames includes a flat cardboard pre-form which is bent into the shape of a hollow triangular cross-section prism having right triangularly-shaped front and rear frame face cover panels joined at vertical and horizontal sides thereof by a vertical and horizontal rectangularly-shaped frame edge cover panel, respectively. Triangularly-shaped spring flaps bent inwardly from hypotenuse edges of the front and rear triangular panels are pressed against and thus grip a frame inserted between the front and rear triangular panels because of the elasticity of the cardboard pre-form. A machine and method for manufacturing corner protectors from a stack of pred-forms bends panels perpendicularly upwards from a pre-form by linear actuators, spays a hot melt adhesive blob onto an upright panel, and presses it against another upright panel to form an adhesive bond.

15 Claims, 16 Drawing Sheets

SLIP-ON CORNER PROTECTORS FOR PICTURE FRAMES AND MACHINE AND METHOD FOR MAKING SAME

This application is a divisional of application Ser. No. 13/397,664 filed Feb. 15, 2012, now U.S. Pat. No. 8,608,887.

BACKGROUND OF THE INVENTION

A. Field of the Invention

The present invention relates to articles for temporary attachment to the corners of flat, rectangularly-shaped frames for holding pictures, diplomas. mirrors and other flat objects to protect the frames and objects from impact damage during shipment and storage, and to machines and methods for making such articles. More particularly, the invention relates to novel slip-on corner protectors installable without tools on the corners of frames, and a novel machine and method for making slip-on corner protectors.

B. Description of Background Art

Picture frames for holding and displaying paintings, photographs, diplomas, certificates and similar flat articles are manufactured in prodigious quantities worldwide. Although picture frames vary in shape and construction details, most frames have a rectangular plan view shape, consisting essentially of four straight channel members or moldings. Each member has an inner channel that intersects channels of adjacent members at a ninety degree angle and four such channel members are fastened together to form a rectangular ring-shaped frame. The channels or recesses in the moldings together to form a rectangular ring-shaped space for receiving the outer peripheral edges of a rectangularly-shaped flat display piece such as a photograph or painting, and optionally, additional flat members such as a backing panel, mat and protective cover glass.

Picture frames of the type described above are made from a variety of materials including, wood, metal and plastic. Whatever material the frame is made of, the geometry of a rectangular picture frame dictates that it have four peripheral members of generally uniform thickness which are joined at each other at forty-five degree miter angles to form ninety-degree corners. These corners are sharp, and are therefore highly subject to breakage, denting or occupied, are fitted with some sort of corner protector during shipment. Such corner protectors are usually made of a relatively inexpensive recyclable material such as cardboard or polystyrene foam. Typical corner protectors of this type are disclosed in U.S. Pat. Nos. 3,955,677, 4,598,825, and 5,447,233. Other patents, related to protecting corners of objects during shipping include U.S. Pat. No. 4,407,898. Also, U.S. Pat. No. 5,255,458 discloses a three-dimensional picture corner and U.S. Pat. No. 4,787,553 discloses a corner fastening device.

In addition to the above-referenced patents related to corner protectors and the like, a variety of machines for bending sheet metal or cardboard of the type used for corner protectors have been disclosed in the following U.S. Pat. Nos. 4,132,102, 4,585,432, 4,713,957, 4,857,038, 4,956,961, and 5,184,998.

None of the aforementioned references disclose a machine for automatically attaching corner protectors to picture frames. Accordingly, the task of attaching corner protectors to picture frames was formerly labor intensive and time consuming. In response to those limitations of the prior art, the present inventor disclosed an automatic Method and Apparatus For Attaching Corner Protectors to Picture Frames, in U.S. Pat. No. 6,018,934. In that patent, the present inventor disclosed a method and apparatus for installing covers to protect picture frame corners from damage during shipment, utilizing thin cardboard pre-forms having symmetric, left and right-hand, right-triangular coverflaps joined at vertical sides thereof to opposite vertical sides of a vertically elongated, rectangular spine flap, the left-hand triangular cover flap having depending downwardly from its base a horizontally elongated rectangular side cover slap, and depending downwardly from the lower lateral edge of the side cover flap a trapezoidally-shaped securement flap. The pre-form is positioned below a picture frame corner, with intersecting side members of the frame vertically aligned with the sides of the left-hand right-triangular coverflap, which serves as a lower face coverflap. The apparatus includes folder mechanisms including flap folder arms which are retractable into recesses provided in a work table, and which are extendible and rotatable to thereby bend the side cover flap and securement flap into a vertical position adjacent a first side of the frame cover and perpendicularly inwardly to overlie the first frame member, bend the spine flap and right-hand triangular cover flap into a vertical position adjacent the second frame member, and bend the right-hand triangular flap perpendicularly inwards from the spine flap to overlie the second and first frame members. An automatic staple gun then inserts a staple downwardly through the right-triangular cover flap in the securement flap and left-hand frame member, securing the corner protector in a folded disposition over the frame corner.

In U.S. Pat. No. 6,418,700, the present inventor disclosed an Automatic Tandem Corner Protector Attachment Method And Apparatus For Picture Frames And The Like, which provided a machine and method similar to those disclosed in the present inventor's U.S. Pat. No. 6,018,934, but provided a capability for simultaneously attaching corner protectors to two corners, thus effectively doubling the through-put or production rate of corner-protected frames.

Also, in U.S. Patent application publication No. US2003/0029552A1, the present inventor further advanced the art of picture frame corner protection by disclosing a Method And Apparatus For Adhesively Bonding Corner Protectors Onto Picture Frames And The Like, in which corner protectors were adhesively bonded to frame corners, and thus could be used on frames made of metal, plastic or any other material, as well as wood, without requiring the insertion of fastener staples into the frame.

The present invention was conceived of to provide a novel slip-on corner protector that could be quickly and easily attached to corners of a picture frame or the like, without requiring the use of any fasteners, tools, or adhesive, and a novel machine and method for manufacturing the slip-on cover protectors.

OBJECTS OF THE INVENTION

An object of the present invention is to provide corner protectors to protect from damage during shipment or transit corners of frames of the type used to hold pictures, mirrors, diplomas and the like, the corner protectors being readily attached to the corners of frames without the use of fasteners or tools by persons such as individuals who are moving framed objects between domiciles or to storage facilities.

Another object of the invention is to provide a machine for manufacturing slip-on corner protectors for picture frames and the like.

Another object of the invention is to provide a method for manufacturing slip-on corner protectors.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends novel slip-on corner protectors for picture frames and the like, and a novel machine and method for manufacturing slip-on corner protectors.

According to the invention, the corner protectors are fabricated from thin sheets of corrugated cardboard that have a smooth, finished obverse side and a plain reverse side. The cardboard sheets are pre-formed by die-cutting, for example, into a pre-form having a novel geometric outline, and subsequently bent into a novel three-dimensional shape.

A preferred embodiment of a pre-form for processing into finished slip-on corner protectors according to the present invention has a mirror symmetric shape about a central longitudinal axis through a longitudinally elongated, centrally located rectangular spine flap section thereof, and has laterally spaced apart left and right-triangularly-shaped frame face-cover sections.

The triangularly-shaped left and right frame face-cover sections are mirror symmetric to each other and have left and right inner longitudinally disposed edges which are joined to left and right outer edges of the central spine flap section by left and right longitudinally disposed fold lines, respectively. Each left and right right-triangularly-shaped frame face-cover section has extending longitudinally outwards from a laterally disposed base thereof a laterally elongated rectangularly-shaped left and right frame edge cover flap section, respectively, which is joined to the base of a left or right right-triangular face cover flap section by a left or right horizontally disposed fold line, respectively.

Each left and right right-triangularly-shaped face coverflap section has protruding laterally outwards from an obliquely disposed hypotenuse edge thereof a smaller right triangularly-shaped left and right spring flap, respectively. Each spring flap has the shape of an inverted right triangle that has a laterally disposed base edge, a longitudinally disposed outer edge, and an obliquely disposed hypotenuse edge which is joined to the hypotenuse of a right-triangular flap section by an obliquely disposed fold line.

According to a method of manufacturing slip-on corner protectors of the present invention, a flat pre-form as described above is formed into a finished slip-on corner protector according to the following steps, the order of which may be varied.

First, the pre-form is horizontally oriented, with the smooth obverse side of the pre-form facing down and rotated 180 degrees around a perpendicular axis to thus orient the longitudinally outwardly frame-edge flaps in a rearward facing direction. Left and right symmetrically-shaped sections of the pre-form including the right-triangularly-shaped left and right frame face cover flaps with outwardly extending spring flaps and longitudinally depending left and right frame edge cover flap sections are then folded perpendicularly upwards from the plane of the central spine flap section along left and right longitudinally disposed fold lines, respectively.

Second, a first one of the originally horizontally disposed and now vertical left and right frame-edge cover flaps is folded perpendicularly inwards from the base of the first right-triangularly-shaped face-cover flap section.

Third, an adhesive blob is applied to the inner facing rear side of the second vertical frame-edge cover flap.

Fourth, the second frame-edge cover flap, bearing the adhesive blob is folded perpendicularly inwards towards the spine flap, and pressed down against the smooth outer surface of the first folded frame-edge cover flap, thereby adhesively bonding together the inner, reverse surface of the second folded frame-edge cover flap to the smooth outer obverse surface of the first folded frame-edge cover flap.

Fifth, a first one of the small right-triangular-shaped spring flaps is bent inwardly towards the longitudinal center line of the pre-form along its obliquely disposed fold line joint with the hypotenuse of a first triangular face-cover flap section. The bend excursion angle exceeds ninety-degrees so that the resultant dihedral angle between the spring flap and the triangular face-cover flap section is less than ninety-degrees, thereby causing the square edge corner of the inwardly bent spring flap to flex elastically upwards and thereby push against and springingly contact the inner surface of the second triangular face-cover flap section.

Sixth, the second spring flap section is folded inwardly from the second triangular face-cover flap in exactly the same manner as the first spring flap section, causing the square edge corner of the second inwardly bent spring flap to flex elastically upwards and therefore push against and springingly contact the inner facing surface of the first inwardly bent spring flap, thus completing fabrication of a finished corner protector.

A finished corner protector that has been folded and glued as described above has the shape of a hollow, right-triangular cross-section prism. The prism has a first right-triangular-shaped base wall panel consisting of a first one of the right-triangular-shaped face cover flap sections, and an upper wall panel parallel to the base wall panel consisting of the second right-triangular-shaped face-cover flap section.

The prismatic form of the finished corner protector also has a first rectangularly shaped side wall vertically disposed between laterally disposed edges of the first, lower and second, upper right-triangularly-shaped face-cover sections. The first vertically disposed, rectangular side wall of a finished corner protector consists of the spine flap section.

The prismatic shape of the finished corner protector according to the present invention also includes a second rectangular side wall vertically disposed between fore-and-aft edges of the upper and lower triangular face-cover flap sections. This second rectangularly-shaped side wall is formed by the left and right edge cover flap sections which are in parallel contact and glued together.

The prism-shaped finished corner protector as described above has a hollow prism-shaped interior space for receiving the corner of a rectangular picture frame. The interior space of the corner protector has a longitudinally elongated, rectangular-shaped entrance opening formed by parallel obliquely disposed edges of the right-triangularly-shaped face-cover flap sections, a transverse edge of the spine flap section, and contacting short edges of the glued-together left and right edge-cover flap sections.

When the corner of a picture frame is aligned with and inserted through the entrance opening of the corner protector and into its hollow interior space, the spine flap section of the corner protector overlies and protects the outer surface of a first frame molding member, and the perpendicularly disposed frame edge cover flap sections overly and protect a second frame molding member perpendicularly joined to the first frame molding member. The first and second right-triangularly-shaped frame face-cover flap sections overlie and protect upper and lower surfaces of the two perpendicular intersecting frame-edge moldings, and the corner faces of the frame.

According to the invention, the elasticity of the cardboard pre-form along the oblique edges of each of the two triangular spring flaps causes the inner facing surfaces of the spring flaps to exert elastic compressive forces on each other. Therefore, when a finished corner protector is pushed onto the corner of a rectangular frame of a picture or other such object, the spring flaps are elastically bent away from each other, and thus exert elastic compressive forces on the frame which secure the corner protector to the frame.

According to another aspect of the present invention, a novel machine for manufacturing slip-on corner protectors is provided which performs the folding and adhesive bonding steps described above.

A slip-on corner protector manufacturing machine according to the present invention includes a generally flat, horizontally oriented work table or base plate which is mounted on a support stand. The machine includes a vertically disposed supply rack or loading magazine for storing a stack of vertically aligned flat, horizontally oriented corner protector pre-forms. The rack consists of an array of vertically oriented guide rods which protrude upwards from a rearwardly located part of the base plate or work table. The guide rods are arranged in a trapezoidal plan view pattern, in which each guide rod contacts a different pair of adjacent intersecting edges of all of the pre-forms in a stack.

A machine for manufacturing slip-on corner protectors according to the invention includes several individual linear actuators, each having a separate double-action pneumatic cylinder which has a longitudinally extendible and retractable actuator rod that extends outwards from a longitudinally slidable piston contained in the cylinder.

According to the invention, each actuator receives pressurized air through a separate set of electrically operated solenoid valves. Each solenoid valve receives an electronic signal from an electronic Programmable Logic Controller (PLC), to open or close the valve to thus perform sequential extensions and retractions of actuator rods in a controlled sequence which forms a finished corner protector from a pre-form.

According to the invention, the various linear pneumatic actuator cylinders include a pre-form feeder actuator cylinder which pulls a pusher plate forward against a rear edge of a pre-form at the bottom of the stack of pre-forms to thereby push the pre-form forward to a folding station location near the middle of the base plate. The machine includes a laterally, centrally located, longitudinally slidable spine flap retainer bar which is driven rearward by another actuator cylinder and thus slid rearward over the upper surface of a pre-form that has been slid forward to the folding station.

The slip-on corner protector fabrication machine according to the present invention also includes a pair of laterally opposed forming cylinders located on left and right sides of the spine flap retainer bar. The forming cylinders have a quiescent rest or home position below the upper surface of the work table or base plate. The forming cylinders are extended upwardly through holes in the base plate to effect the first vertical folds of left and right sides of a pre-form, when actuator cylinders connected to bottom ends of the forming cylinders push the forming cylinders upwards, and are retracted below the surface of the work table or base plate after a pre-form has been worked into a finished corner protector.

According to the invention the slip-on corner protector fabrication machine includes five additional pneumatic actuator cylinders mounted to the upper surface of the work table/base plate, and an electrically operated spray hot-melt adhesive gun. The actuators and spray hot melt adhesive gun perform in sequence the folding and gluing steps required to fabricate a finished corner protector from a blank cardboard pre-form, as described above.

The machine according to the invention includes a solenoid valve actuated air nozzle, which outputs a jet of air at the end of a folding cycle for each corner protector to blow a finished corner protector off of the base plate and into a collector bin.

DESCRIPTION OF THE PREFERRED EMBODIMENTS

FIGS. 1-7 illustrate a machine for manufacturing slip-on corner protectors according to the present invention.

Figure 8:
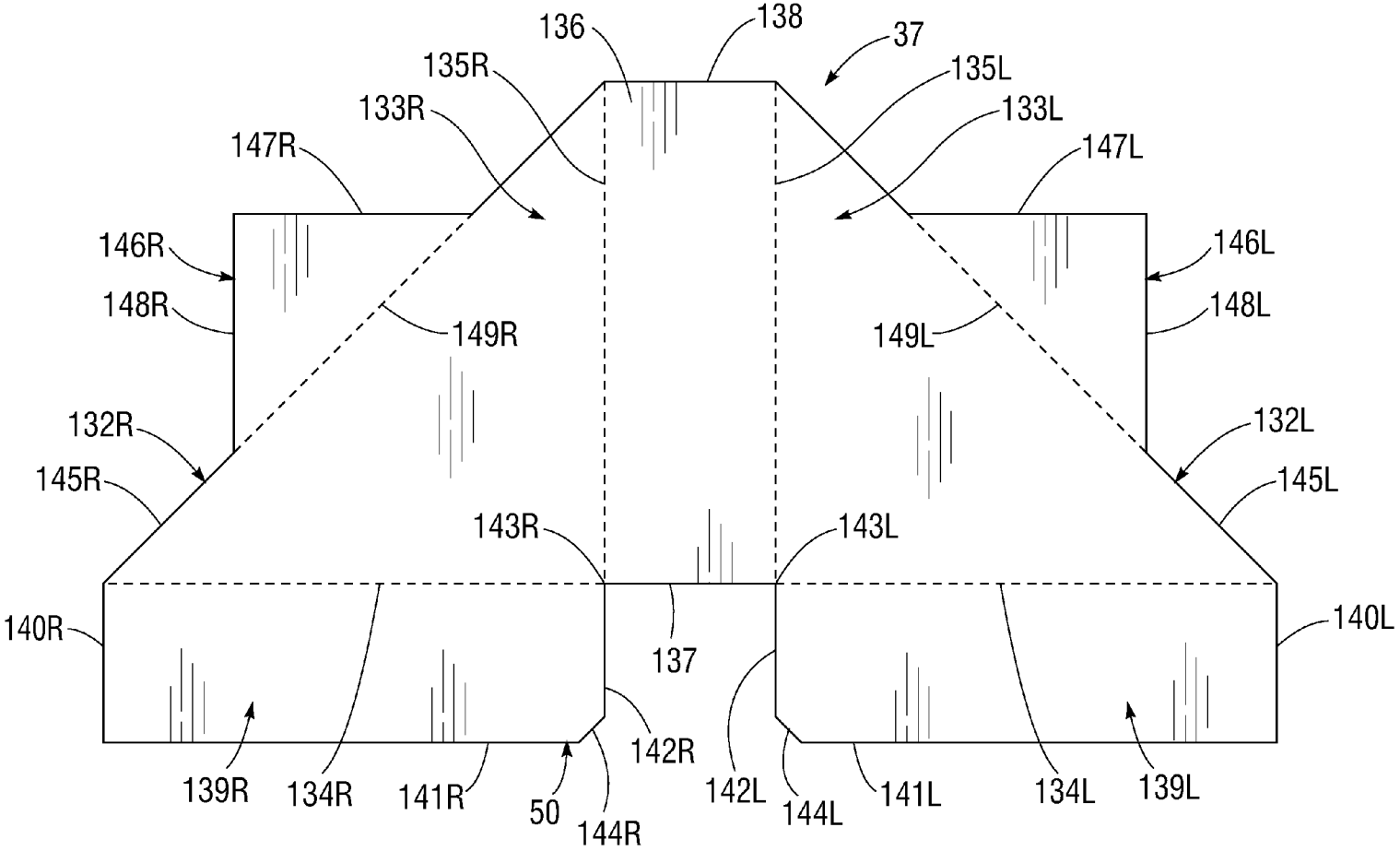
FIG. 8 is an upper plan view of a corner protector blank according to the present invention

FIG. 8 illustrates a blank or pre-form of the type used in the machine of FIGS. 1-6 to fabricate finished slip-on corner protectors.

FIGS. 9-25 illustrate how the machine of FIGS. 1-7 is used to fabricate finished slip-on corner protectors from pre-forms of the type shown in FIG. 8.

Figure 26:
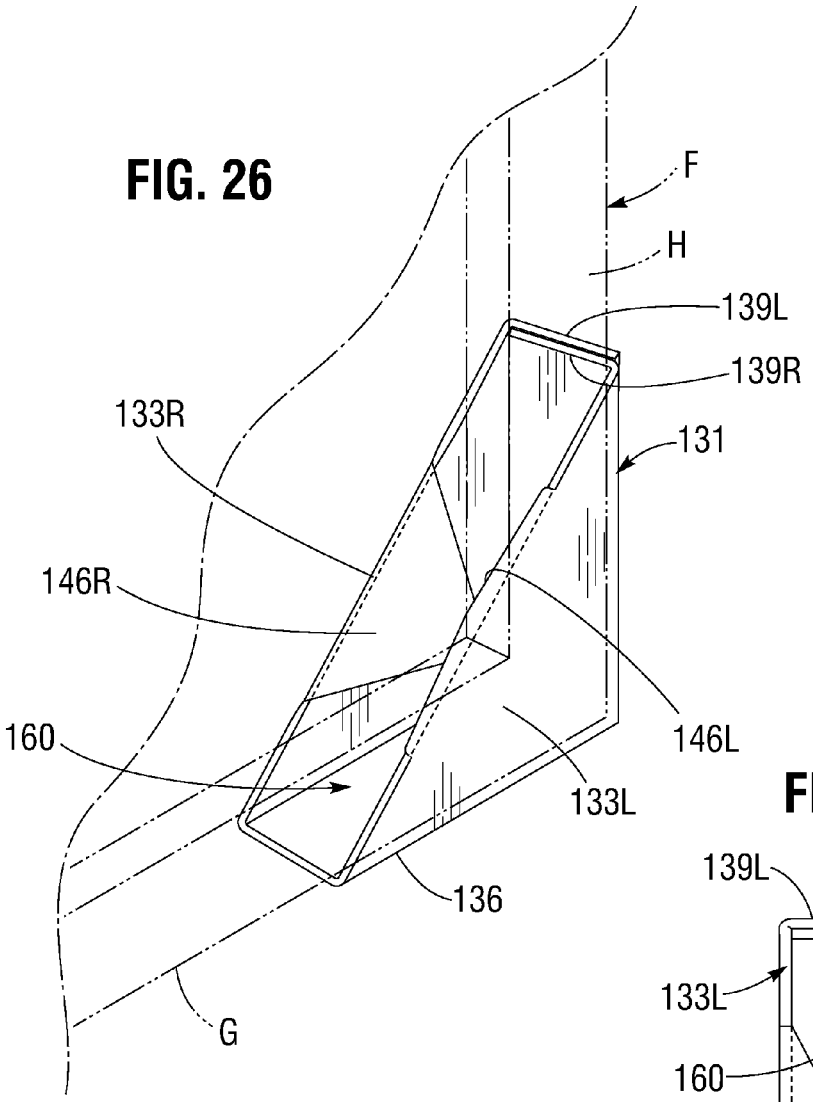
FIG. 26 is a perspective view of a finished corner protector slipped onto a corner of a frame.
Figure 27:
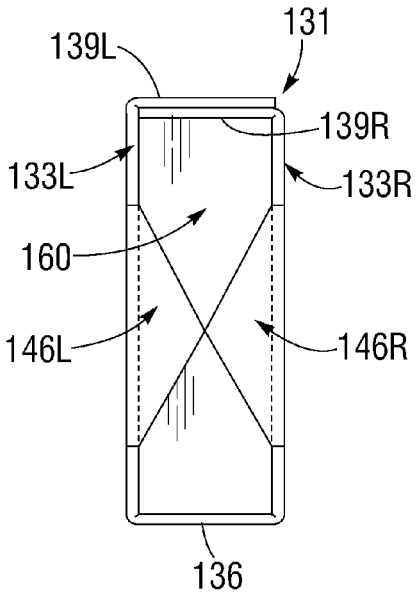
FIG. 27 is an upper view of the finished corner protector shown in FIG. 26.

FIGS. 26 and 27 show a finished corner protector and how it is placed on the corner of a framed object.

Referring now to FIGS. 1-7, it may be seen that a machine 30 for fabricating slip-on corner protectors includes a longitudinally or fore-and-aft elongated, generally rectangularly-shaped work table or base plate 31. Base plate 31 is supported in a horizontally disposed orientation by a support stand 32, which may be placed on the floor of a factory or other manufacturing location.

As shown in FIGS. 1-7, support stand 32 has generally the shape of a hollow, longitudinally rectangular box which has a hollow interior space 33, that contains various components of the machine 30, including an electronically Programmable Logic Controller (PLC) 34. The PLC 34 contains in electronic memory program instructions which cause the PLC to issue in a pre-programmed sequence electronic interrupt signals that are input to various components of the machine.

As will be described in detail below, the components of machine 30 include individual linear actuators such as rear actuator cylinders 86L, 86R which are preferably double-action pneumatic cylinders that are operated by pressurized air conducted to the cylinders through solenoid valves which are located in a valve box 233 and are opened and closed by interrupt signals received from the PLC 34.

Machine 30 also includes a hot-melt adhesive or glue gun 239 which sprays out a jet of hot adhesive upon receipt of an electronic command signal from the PLC 34. Machine 30 also has a control panel 248 which has control switches and indicators for controlling and monitoring operation of the machine. The structures and functions of a PLC and interconnected control switches, sensors and indicators used in automated machinery for the automated manufacture of articles are well known to those skilled in the art of automated machinery and will not be discussed in further detail.

As shown in FIGS. 1-7, machine 30 includes a loading magazine or pre-form supply rack 36 for holding a vertical stack of corner protector pre-forms 37 of the type shown in FIG. 8. As shown in FIGS. 1-3 and 5-7, loading magazine 36 has a skeletal structure consisting essentially of 6 vertical guide rods 38A-38F which are mounted perpendicularly to the upper surface 39 of work table or base plate 31.

Figure 3:
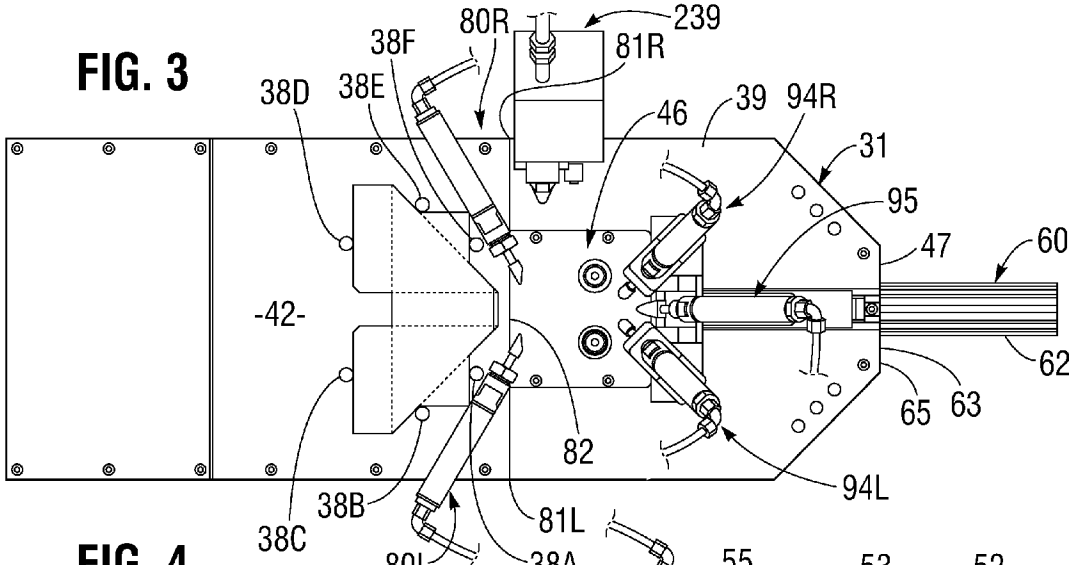
FIG. 3 is an upper plan view of the machine of FIG. 1.

As may be understood by referring to FIG. 3, the bases of the guide rods 38A-38F are mounted at the vertices of a generally trapezoidally-shaped plane figure, in a manner which positions each rod at an intersection point or vertex of a separate pairs of intersecting sides of a pre-form 37.

Figure 7:
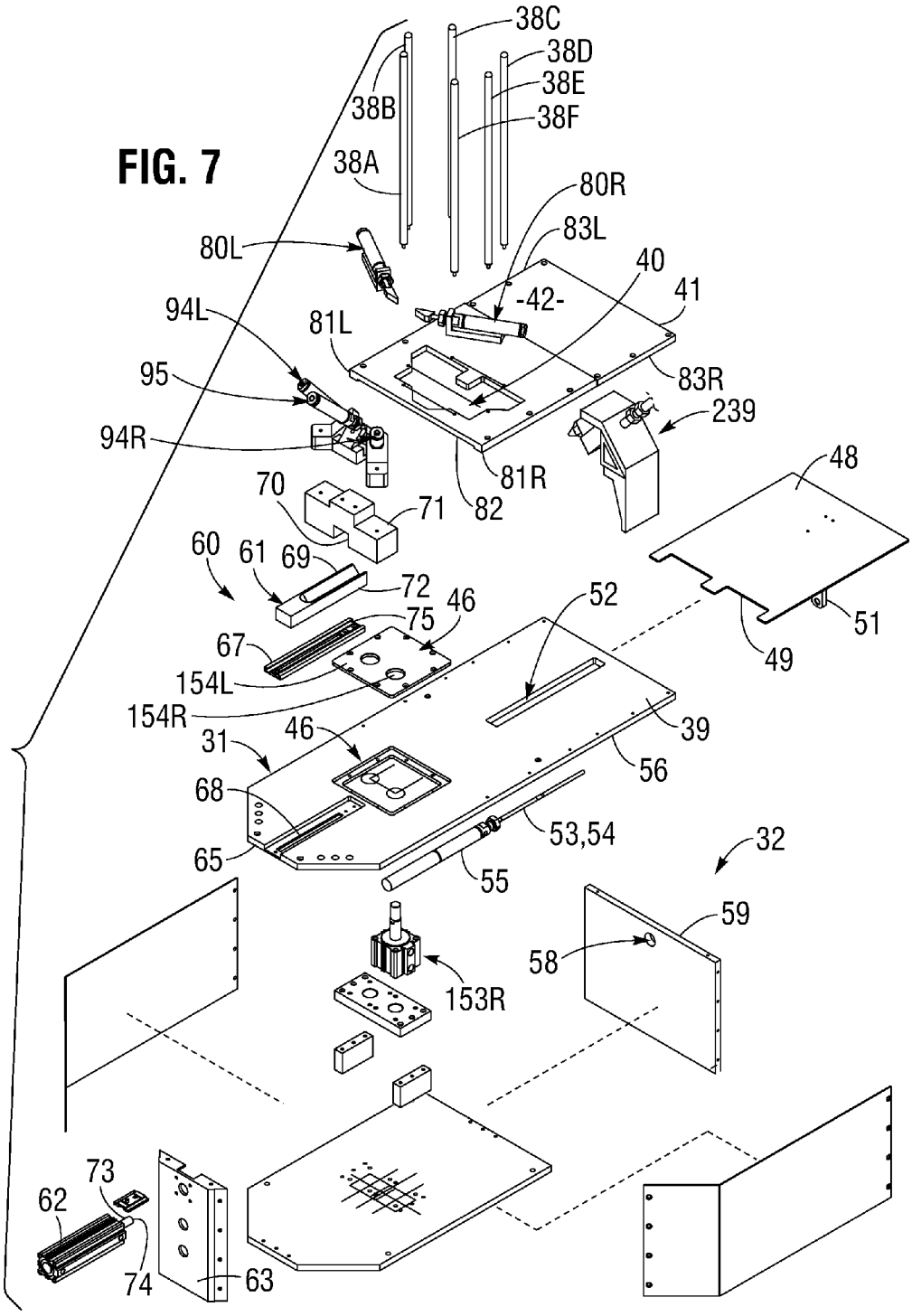
FIG. 7 is an exploded fragmentary view of the machine of FIGS. 1-3

As shown in FIGS. 3 and 7, the bases of guide rods 38A-38F are mounted adjacent to intersecting inner peripheral vertical walls of an aperture 40 through the thickness dimension of a flat, rectangularly shaped guide plate 41 which is seated on the upper surface 39 of work table base plate 31. As shown in the figures, aperture 40 is congruent to the plan view shape of a pre-form 37, i.e., has the same shape and size as the plan-view shape and size of pre-forms 37. Thus, aperture 40 conformally holds the bottom pre-form 37 in a vertical stack of pre-forms held in loading magazine 36.

Figures 10, 11:
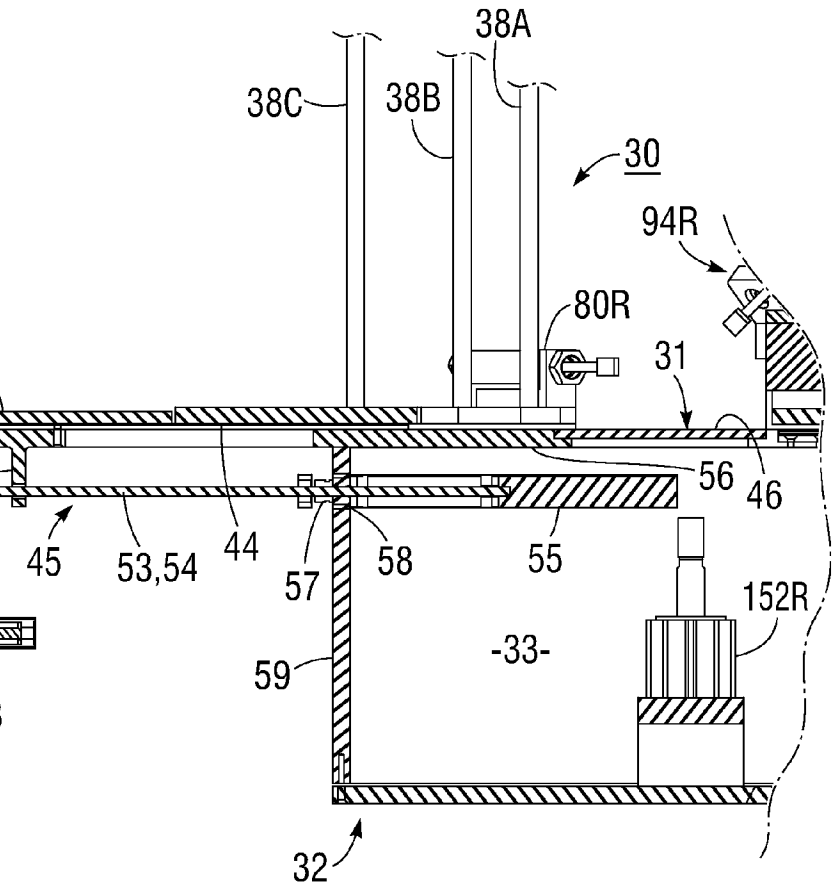
FIG. 10 is a vertical medial longitudinal sectional view of the machine of FIG. 1.
FIG. 11 is a fragmentary view of FIG. 10, on an enlarged scale.

As may be seen best by referring to FIGS. 7, 10 and 11, guide plate 41 has a longitudinally elongated rectangular shape, and a flat upper surface 42. Guide plate 41 has formed in a lower surface 43 thereof a longitudinally disposed, rectangularly-shaped recess 44 which extends rearwards from the front vertical edge wall 82 of the guide plate to a location rearward of the rear laterally disposed edge of aperture 40 through the guide plate.

Recess 44 has a width slightly larger than that of pre-form aperture 40, and a vertical depth or thickness slightly greater than that of a pre-form 37. Thus, a pre-form 37 which, under the force of gravity acting on it and a stack of pre-forms above has descended through aperture 41 into recess 44, may be slid forward on the upper surface 39 of base plate/work table 31 to a forwardly located folding station 46 on the upper surface of the base plate, in a manner which will now be described.

Referring to FIGS. 1,4,7, 10 and 11, it may be seen that machine 30 includes a pre-form feeder mechanism 45 for moving individual flat blank pre-forms 37 forward to a laterally centrally located folding work station 46 closer to the front edge 47 of the work table. As shown in FIG. 7, pre-form feeder mechanism 45 includes a thin, flat slider plate 48 which has a generally rectangular, longitudinally elongated shape. A front edge 49 of slider plate 48 has an E-shape which is generally complementary to the shape of the rearwardly facing lower laterally disposed edge 50 of a pre-form 37. Thus, when slider plate 48 is moved forwards in recess 44, front edge 49 of the slider plate abuts the rear edge 50 of a pre-form 37 and slides the pre-form forward on the upper surface 39 of work table 31 to forwardly located folding station 46.

As shown in FIGS. 7, 10 and 11, pre-form feeder mechanism 45 includes a vertically disposed drive pin 51 which depends downwardly through a centrally located, longitudinally disposed aperture slot 52 through a rear portion of work table/base plate 31. A lower end of drive pin 51 is connected by a horizontally disposed link pin 53 to the rear end of the piston rod 54 of a feeder mechanism pneumatic linear actuator cylinder 55.

Figure 4:
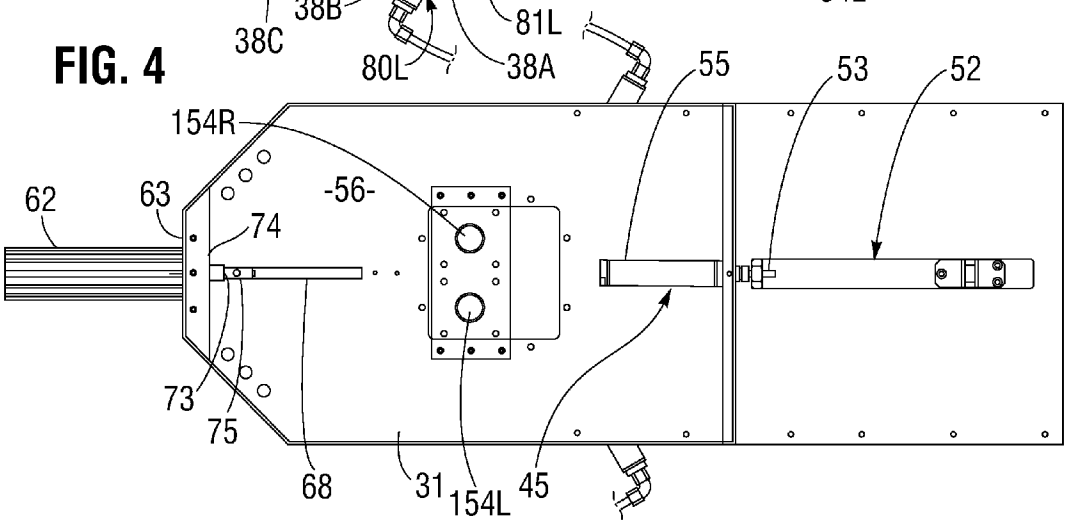
FIG. 4 is a lower fragmentary view of the machine of FIG. 1, showing a lower surface of a base plate/work table of the machine.

As shown in FIGS. 4 and 11, feeder mechanism actuator cylinder 55 is mounted below lower side 56 of a work table/base plate 31. As shown in the figures, feeder mechanism actuator cylinder 55 is horizontally and longitudinally disposed along a longitudinal center line of work table/base plate 31. As is also shown in FIGS. 7 and 11, the rearwardly extending outer end 57 of piston rod 54 of feeder mechanism actuator cylinder 55 is disposed rearwardly through a clearance hole 58 through a rear vertical panel 59 of support stand 32.

The structure of pre-form feeder mechanism 45 described above enables individual pre-forms 37 to be advanced to folding work station 46.

FIGS. 1-6 illustrate various forming mechanisms using linear actuators of machine 30 that are used to fabricate a finished slip-on corner protector from a pre-form 37 which has been advanced forward on upper surface 39 of work table 31 to a folding station location or station 46 by pre-form feeder mechanism 45, as described above.

As shown in FIGS. 1-7, and 14, machine 30 include a spine flap retainer or hold-down mechanism 60 that includes a spine flap hold-down bar 61. Spine flap hold-down mechanism 60 includes a pneumatic actuator cylinder 62 mounted to a front panel 63 of machine support frame 32. As shown in the figures, cylinder 62 lies on a longitudinally disposed center line of work table/base plate 31, is located a short distance below the lower surface 56 of work table/base plate 31, and extends perpendicularly forwards of front laterally disposed edge 65 of the work table.

As shown in FIG. 7, spine flap retainer hold-down mechanism 60 includes a longitudinally elongated, generally square cross-section rectangular hold-down bar 61 which has a lower section 67 that is longitudinally slidably mounted in a longitudinally disposed, laterally centrally located slot 68, that extends rearwardly from front edge 65 of work table/base plate 31 towards folding station 46.

Figure 9:
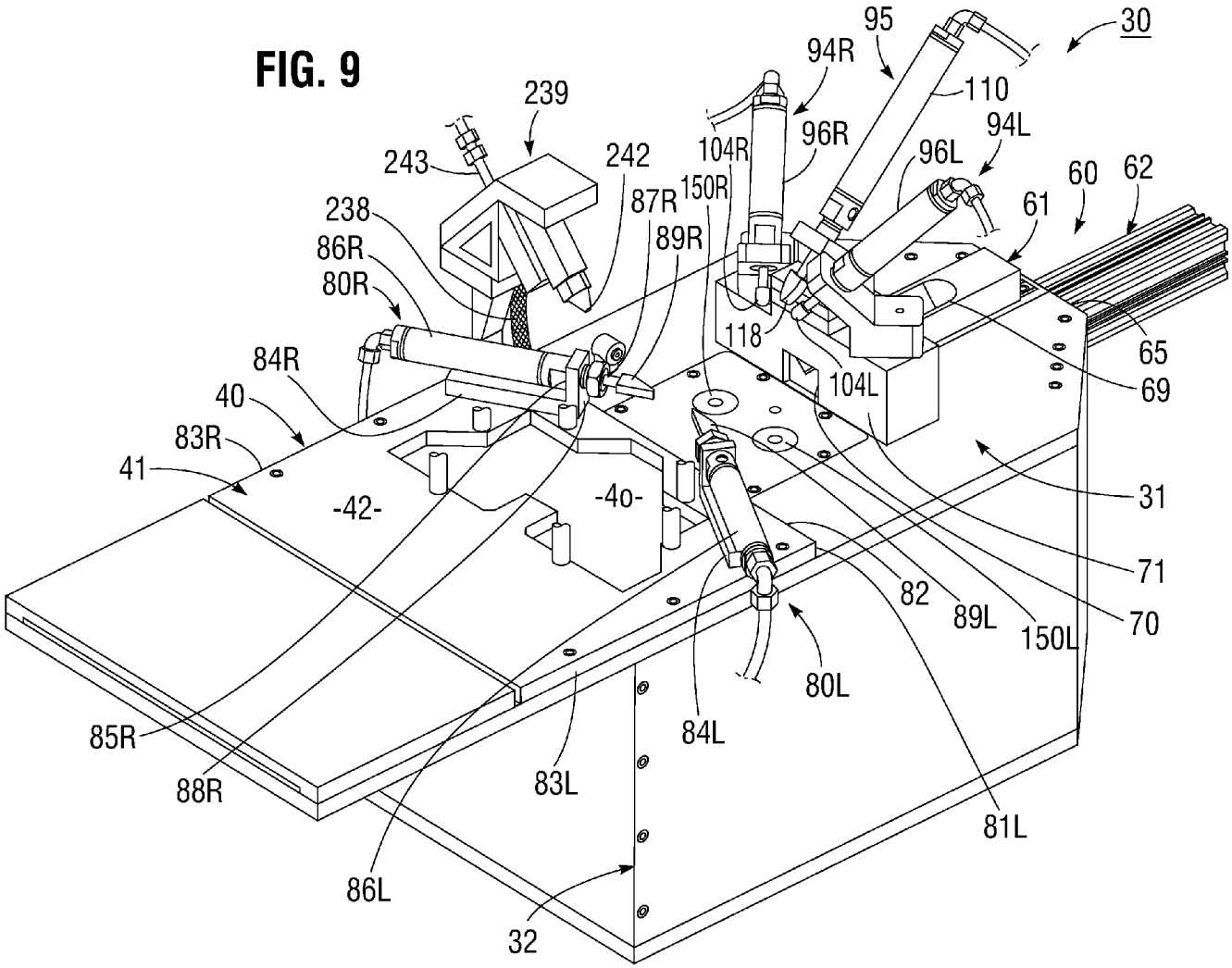
FIG. 9 is a left-rear perspective view of the machine of FIGS. 1-4.
Figure 14:
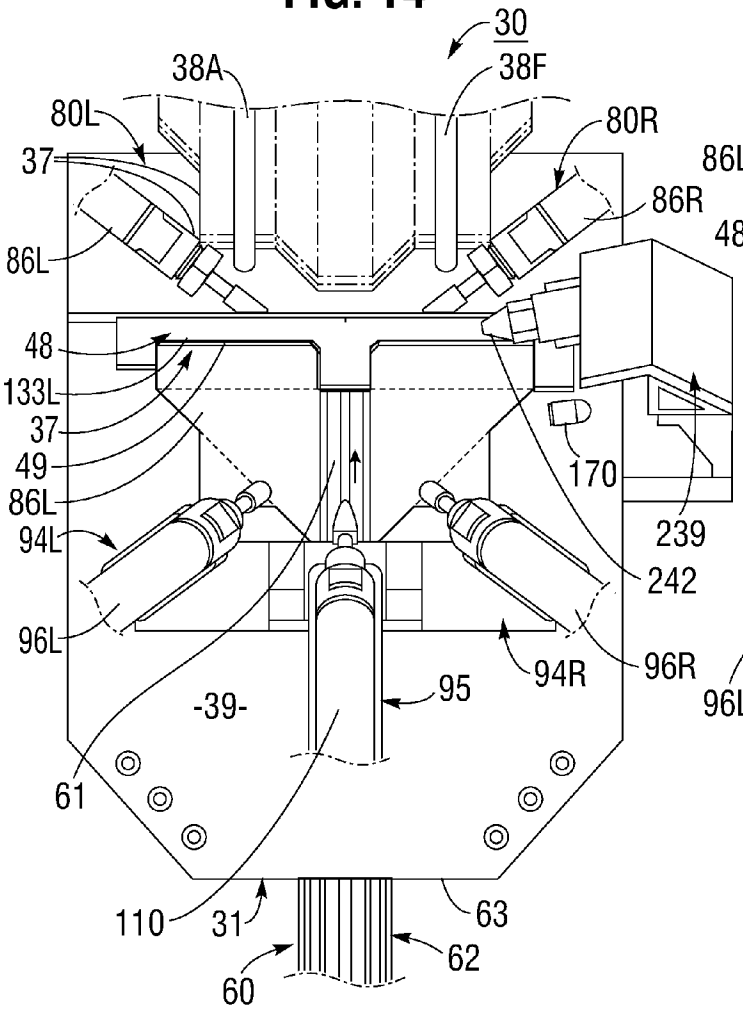
FIG. 14 is a view similar to that of FIG. 13, but showing a spine holder bar of the machine extended fully rearwards over a spine flap section of the blank

As shown in FIGS. 7 and 9, when hold-down bar 61 is slid fully rearwards in slot 68, an upper part 69 of the hold-down bar above the upper surface 39 of work table/base plate 31 extends rearwardly through a central longitudinally disposed rectangular cross section aperture or archway 70 through a transversely disposed rectangular saddle block 71 that protrudes perpendicularly upwards from the upper surface of the work table. As shown in FIG. 14, when the upper part 69 of hold-down bar 61 is extended fully forward through aperture 70 through saddle block 71, the lower surface 72 of the hold-down bar presses down against the upper surface of a spine flap section of a pre-form 37, prepositioned at folding station 46.

As may be understood by referring to FIGS. 4 and 7, cylindrical reciprocating motion of hold-down bar 61 from a front home position to a rear hold-down position is effected by reciprocating motion of the rear end 73 of piston rod 74 which extends rearwardly from pneumatic cylinder 62 and is linked to a lower surface of hold-down bar 66 by a vertically disposed pin 75 which is longitudinally movable in slot 68.

Referring to FIGS. 3,7 and 9, it may be seen that machine 30 includes five folding mechanisms mounted on the upper surface 39 of work table/base plate 31. These include a rear pair of laterally opposed left and right folder mechanisms 80L, 80R which are mounted to the upper surface 42 of feeder mechanism guide plate 40.

As shown in the figures, left and right rear folder mechanisms 80L, 80R are substantially identical in construction and are mounted at mirror symmetric locations on upper surface 42 of feeder mechanism guide plate 40 near front corners 81L, 81R of the guide plate formed by the intersection of front vertical surface 82 of the guide plate with left vertical side surface 83L, and the intersection of the front vertical surface 82 with right side vertical surface 83R.

As shown in FIGS. 7 and 9, each rear folder mechanism 80L, 80R includes a L-shaped mounting bracket 84L, 84R in which is clamped the outer surface of a front part of the body 85L, 85R of a pneumatic actuator cylinder 86L, 86R. As shown in the figures, the longitudinal axes of left and right rear actuator cylinders 86L, 86R lie in a common horizontal plane, and are disposed obliquely to a longitudinal center line of upper surface 39 of work table/base plate 31, at an angle of about 30 degrees to the laterally disposed front vertical surface 82 of feeder mechanism guide plate 40.

As shown in FIGS. 9, 12, 16 and 18, each of left and right rear folder mechanisms 80L, 80R includes an actuator piston rod extension 87L, 87R which is extendable forward from a retractable rearward position relative to a front vertical surface 88L, 88R of L-shaped mounting bracket 84L, 84R, obliquely inwardly and forwardly towards the longitudinal center line of work table/base plate 31. As shown in the figures, each vertical piston rod extension 87L, 87R has at the outer end thereof a forming shoe 89L, 89R, which has in an upper plan view the shape of a uniform transverse cross-section wedge-shaped prism, including a short base 90, a long rear face 91 perpendicular to the base, a short front face 92 parallel to rear face 91, and a vertically disposed, arcuately curved convex forming face 93 disposed obliquely between the front and rear parallel faces.

Referring to FIGS. 3,7 and 9, it may be seen that machine 30 includes three additional folding mechanism 94L, 94R and 95 which are mounted to the upper surface of work table/base plate 31, at locations forward of folding station 46. The structure and mounting of the front folding mechanisms 94L, 94R and 95 are similar to those of rear folder mechanisms 80L, 80R with the following exception.

Figures 1, 2:
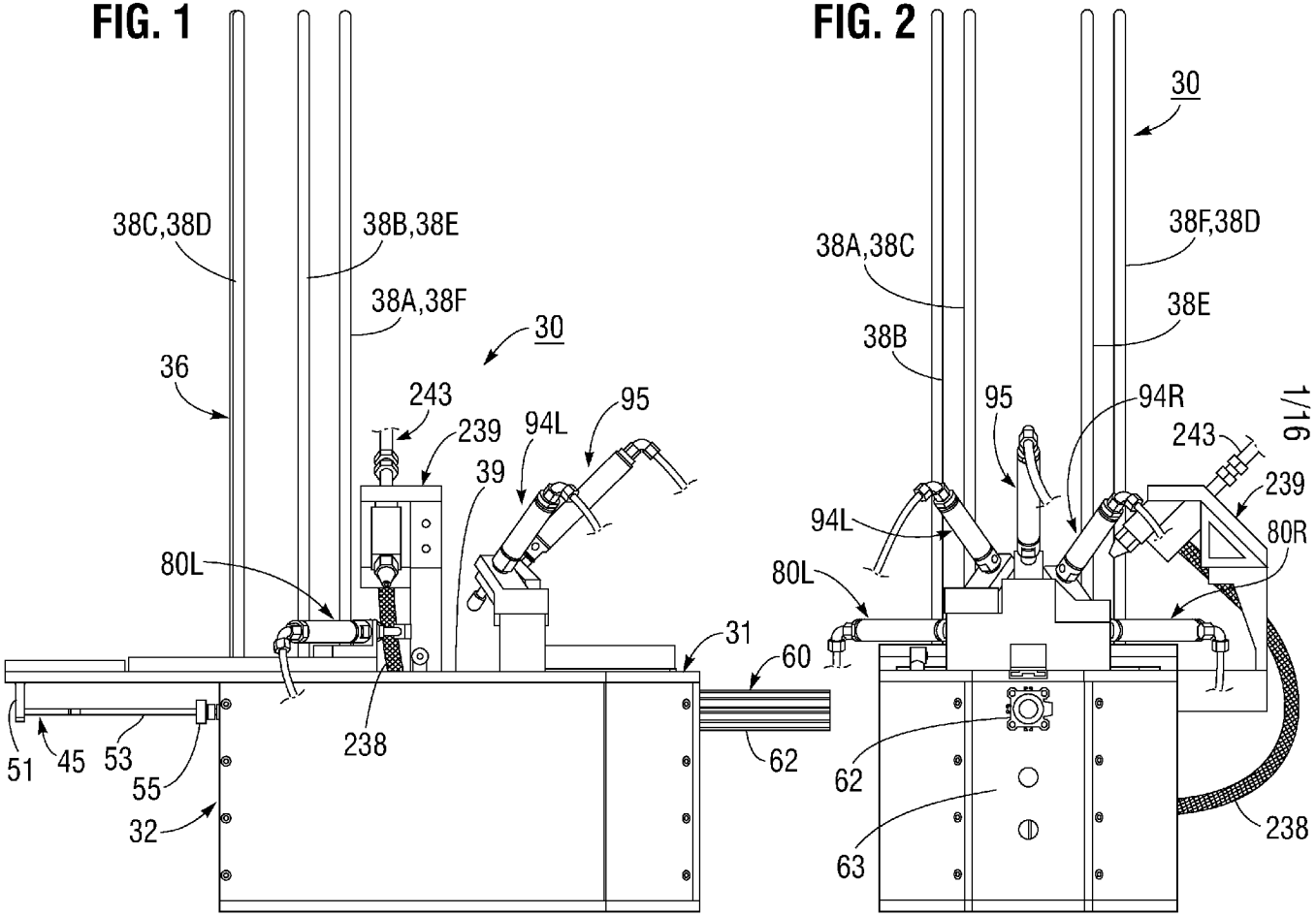
FIG. 1 is a left-hand elevation view of a machine for fabricating slip-on corner protectors for picture frames according to the present invention, with certain air hoses thereof broken away for clarity.
FIG. 2 is a front elevation view of the machine of FIG. 1
Figure 25:
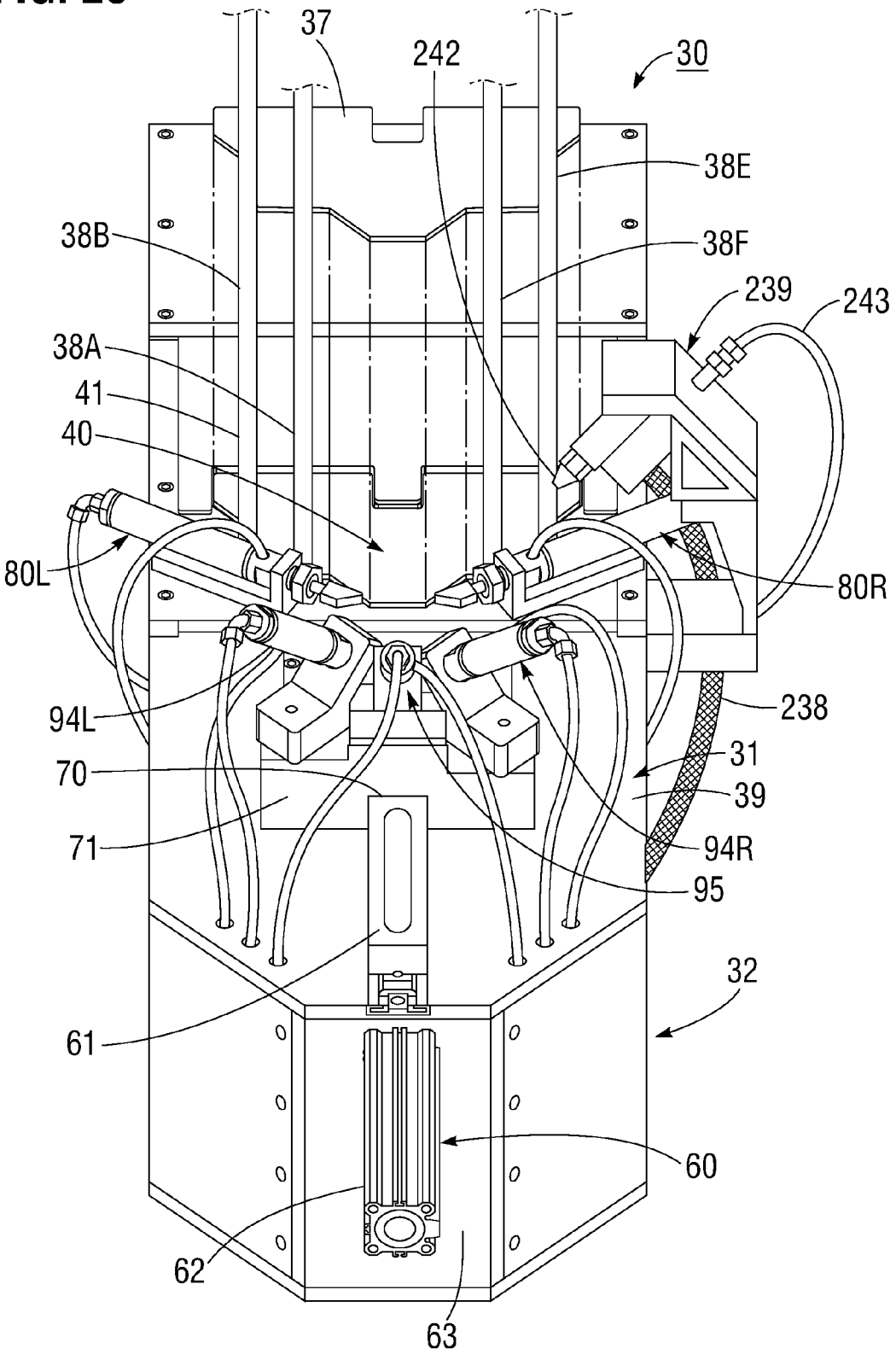
FIG. 25 is a front perspective view of the machine of FIGS. 1-6

As shown in FIGS. 2, 9 and 25, left and right front folder mechanism 94L, 94R are substantially identical in construction and function, and are mounted at mirror symmetric locations on left and right sides of the upper surface 39 of base plate 31 at locations a short distance forward of folding station 46.

As shown in FIGS. 2,9 and 25, left and right front folder mechanisms 94L, 94R each includes a pneumatic cylinder 96L, 96R which has a longitudinal axis that angles downwardly and laterally inwardly towards the longitudinal center line of folding station 46 on the upper surface of work table/base plate 31. In a vertical plane through each cylinder 96L, 96R, the longitudinal axis of the cylinder is inclined at an angle of about 30 degrees from a vertical direction. In a horizontal plane, left and right front cylinders 96L, 96R angle laterally inwards towards a longitudinal center line of base plate/work table 31 at an angle of about 30 degrees relative to front laterally disposed edge 65 of the work table.

As shown in FIGS. 2,9 and 25, each front folder mechanism 94L, 94R includes a mounting bracket 97L, 97R in which is clamped the outer surface of a front end portion of pneumatic cylinders 98L, 98R, respectively. Each mounting bracket 97 includes a longitudinally and vertically elongated rectangularly-shaped base block 99 which is mounted to and extends perpendicularly upwards from upper surface 39 of base plate/work table 31. Each base block 99 has mounted to an upper flat horizontal surface 100 thereof a flat mounting plate 101 which is angled upwardly from the surface 100 at a dihedral angle of about 60 degrees. Each mounting plate 101 has at a forward end thereof an angled flat plane surface 102 which perpendicularly mounts the front transversely disposed end wall of a pneumatic cylinder 96.

Figure 12:
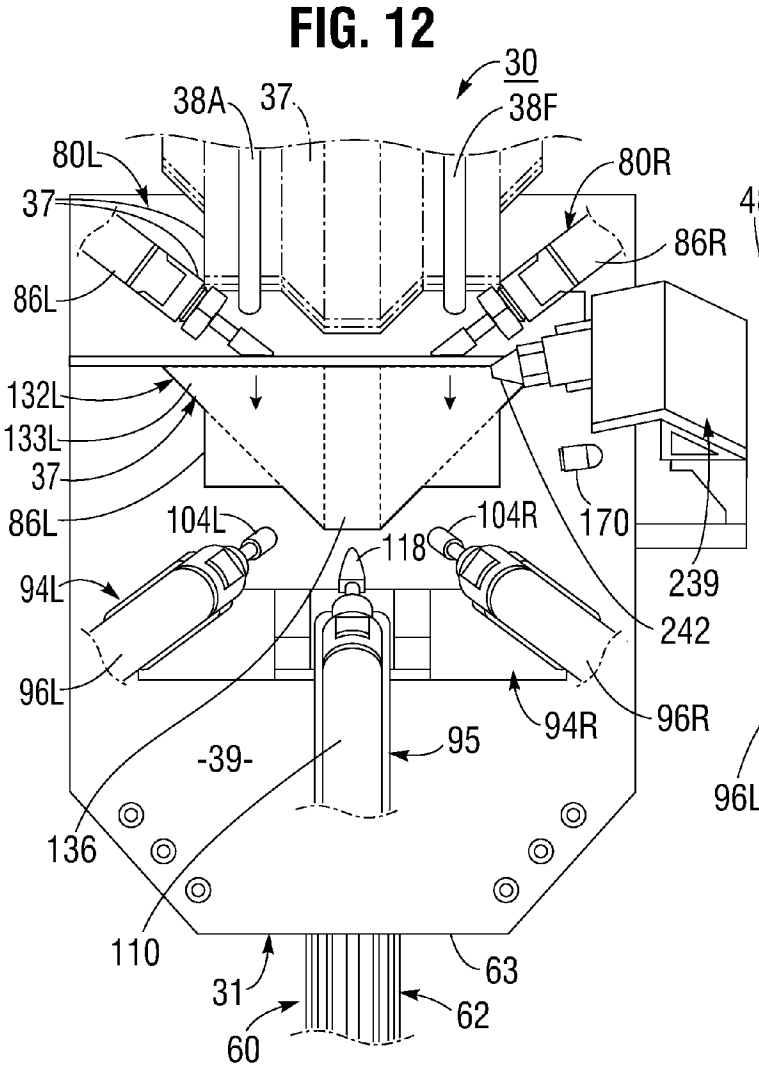
FIG. 12 is a fragmentary upper view of the machine of FIGS. 1-6 showing a corner protector blank of FIG. 8 being advanced from a supply stack to a forming location on the base plate/work table of the machine

As shown in FIGS. 9 and 12, each of left and right front folder mechanisms 94L, 94R includes an actuator piston rod extension 103L, 103R which is extendable rearward from a retractable forward position relative to rear angled surface 102L, 102R, obliquely downwardly, rearwardly, and inwardly towards the longitudinal center line of work table/base plate 31.

As shown in FIGS. 9 and 12, each angled piston rod extension 103L, 103R has at the outer extendable end thereof a rounded bumper 104L, 104R which has generally the shape of a spherical section.

Referring to FIGS. 9 and 12, it may be seen that center front folder mechanism 95 includes a pneumatic cylinder 110 which has a longitudinal axis that lies in a vertical longitudinally disposed center plane of base plate/work table 31, at an angle of about 60 degrees upwardly from the upper surface 39 of the base plate. Pneumatic cylinder 110 of center front folder mechanism 95 is supported by a mounting bracket 111 which extends upwardly from upper surface 39 of base plate/work table 31.

Mounting bracket 111 includes a base block 112 and an upper angled mounting plate 113 which is angled upwardly at an angle of about 60 degrees relative to the upper surface 39 of base plate/work table 31. Mounting plate 113 has at an upper end thereof a flat plane surface 114 which perpendicularly mounts the front transversely disposed end wall 115 of pneumatic cylinder 110.

As shown in FIGS. 9 and 12, center front folder mechanism 95 includes an actuator piston rod extension 116 which is extendable rearward from a retracted forward position relative to a rear angled surface 117, obliquely downwardly and inwardly towards upper surface 39 of base plate 31.

As shown in FIGS. 9 and 12, angled piston rod extension 116 has at the outer extendable end thereof a forming shoe 118, which has in an upper plan view the shape of a uniform transverse cross-section laterally symmetric wedge-shaped prism. Thus, shoe 118 has a flat rear transversely disposed base 119 fastened to the outer end of piston rod extension 116, and left and right sides 120L, 120R which angle longitudinally inwardly and rearwardly towards a convex, arcuately curved rear forming face 121.

As shown in FIGS. 3, 4, 7, 9-11 and 15, machine 30 includes a pair of laterally opposed left and right forming cylinders 150I. 150R which are located near a front edge 151 of workstation 46. As shown in the figures, each forming cylinder 150L 150R is located adjacent to a left and right longitudinally disposed edge, respectively of spine flap hold-down bar 61, when the spine flap hold-down bar has been extended rearwardly on base plate 31.

As shown in FIGS. 7 and 9, forming cylinders 150L, 150R are laterally aligned and equidistant from a vertical longitudinally disposed center plane of work station 46.

Figure 13:
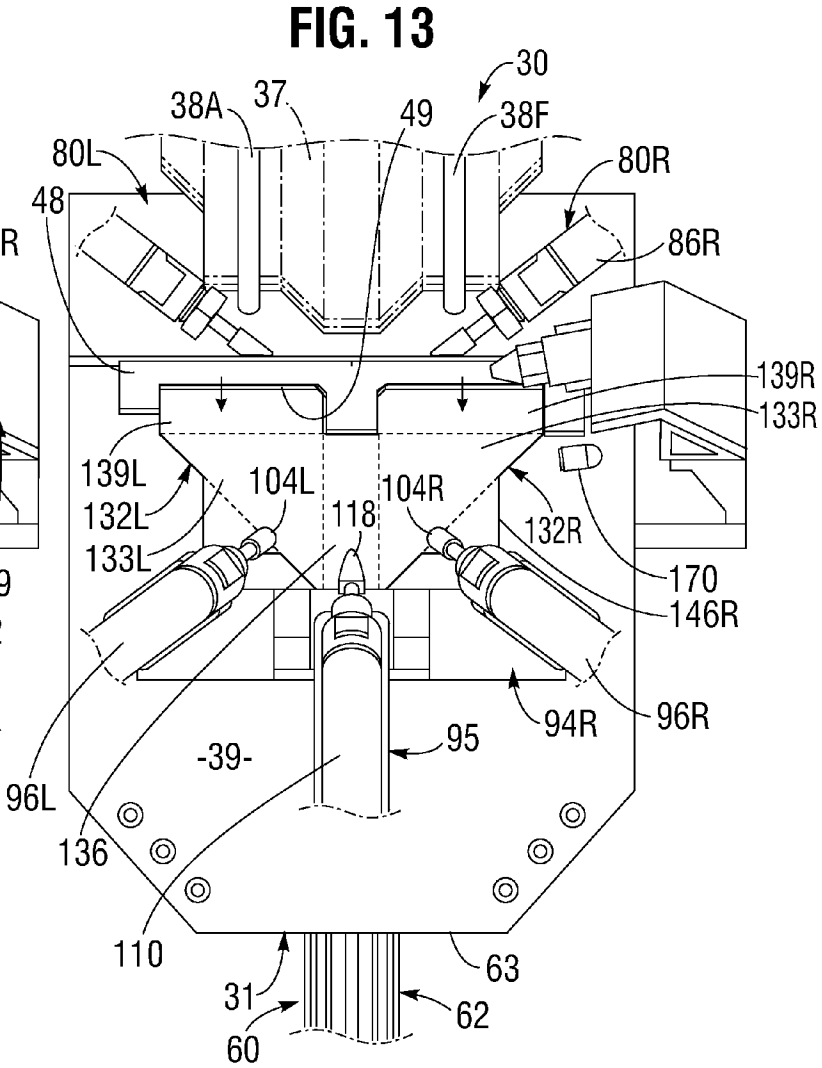
FIG. 13 is a view similar to that of FIG. 12, but showing the blank advanced fully forward into the forming location.

Left and right forming cylinders 150L, 150R are attached to the upper ends of piston rods 153L, 153R of left and right pneumatic actuator cylinders 152L, 152R located below base plate/work table. With the piston rods retracted downwards to their rest or home positions, the forming cylinders 150L, 150R are retracted downwards in left and right bores 1541, 154R disposed vertically through base plate/work table 31, so that the upper transverse end faces 155L, 155R are positioned slightly below upper surface 39 of base plate 31,*f* as shown in FIG. 9. When pneumatic actuator cylinders 152L, 152R are pressurized, forming cylinders 150L, 150 R are extended vertically upwards through bores 154L, 154R so that the upper transverse and faces 155L, 155R of the cylinders are extended above the upper surface 39 of base plate 31, as shown in FIG. 13

Figures 5, 6:
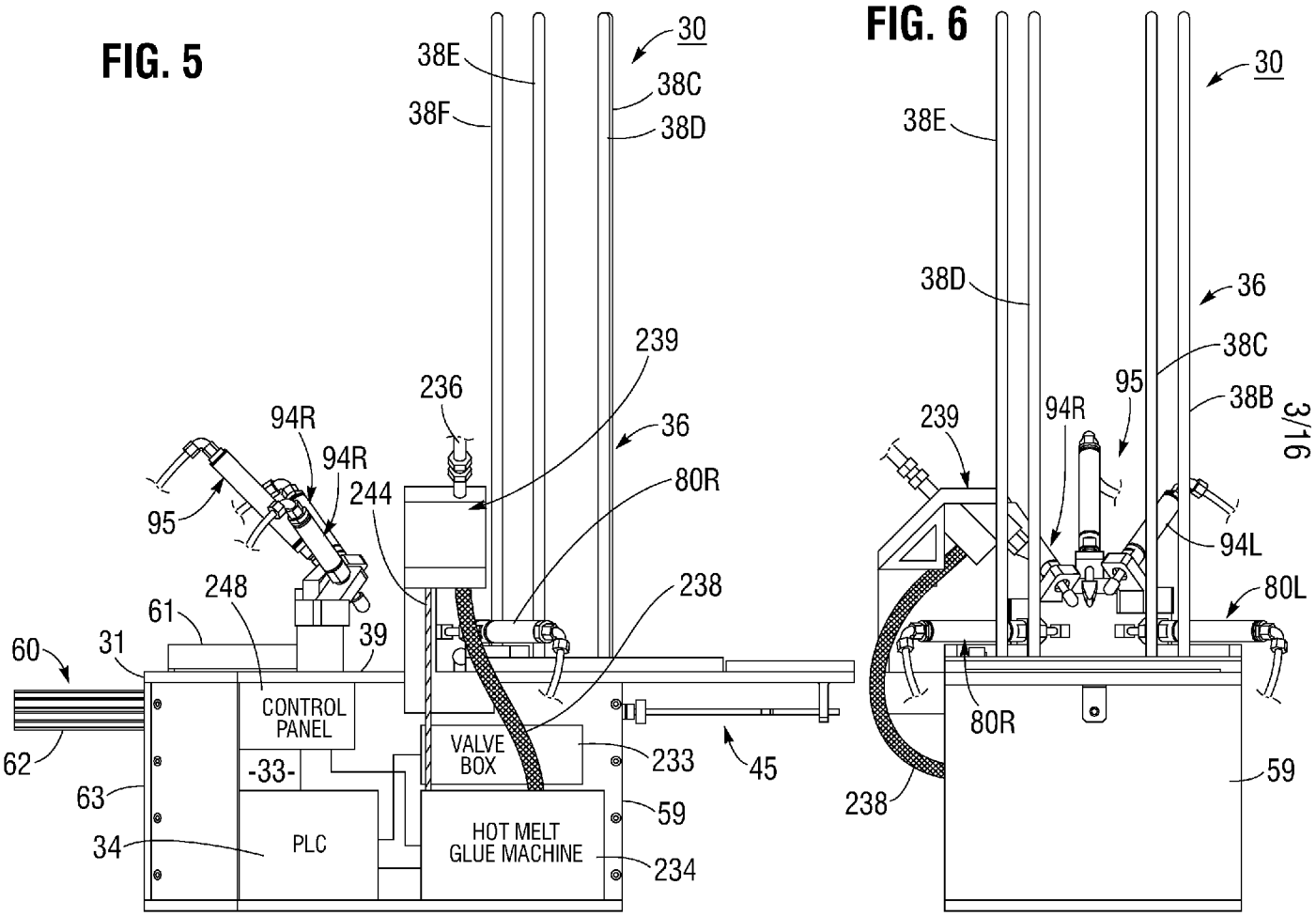
FIG. 5 is a partly broken away, partly diagrammatic right-hand elevation view of the machine of FIG. 1
FIG. 6 is a rear elevation view of the machine of FIG. 1.

As shown in FIGS. 1, 5, and 25, machine 30 includes an adhesive dispenser apparatus 236 for dispensing quantities of adhesive used to bond together frame-edge cover flaps 139L, 139R of a corner protector pre-form 37 to form a finished corner protector 131, in a manner which will be described below.

Apparatus 236 preferably includes a hot-melt adhesive machine 237 for melting solid polymer sticks and pumping the molten polymer through a thermally blanketed high pressure hose 238 to an applicator head 239. As shown in the figures, applicator head 239 has an elongated body 240 including a generally rectangular block-shaped front portion 241 which has protruding obliquely downwards therefrom an adhesive dispensing nozzle 242. Hot melt adhesive dispenser apparatus 236 includes a pressurized air hose 243 and an electrical control cable 244 which are interconnected between machine 237 and applicator head 239.

Machine 237 includes an internal heater and internal control mechanisms which, in response to electrical command signals from PLC 34, cause molten adhesive to be pumped from the machine through hose 238 to applicator head 239. Control signals conducted through control cable 244 to applicator head 239 control valves which enable pressurized air supplied to the applicator head through air hose 243 to spray a jet of pressurized molten hot-melt adhesive onto the inner surface of a frame-edge cover flap 139L, so that it may be adhered to the outer surface of a frame-edge cover flap 139R to complete fabrication of a finished corner protector 131.

FIG. 8 illustrates a cardboard blank or pre-form 37 according to the present invention. Machine 30 as described above is used to process pre-forms 37 into finished corner protectors 131, as shown in FIG. 26, in a manner which will be described in detail below.

As shown in FIG. 8, pre-form 37 is made of a thin sheet of readily bendable material, such as corrugated cardboard. Pre-form 37 has two laterally symmetric, left and right panel sections 132L, 132R. The left and right panel sections include left and right right-triangular panels 133L, 133R which form protective covers for faces of a frame in a finished corner protector 131, as shown in FIG. 26.

Each left and right triangular face-cover panel section 133L, 133R has a laterally disposed base 134L, 134R, respectively, and at a laterally inwardly located end of the base, a longitudinally disposed altitude 135L, 135R, respectively. Altitudes 135L, 135R of right triangularly-shaped left and right cover panel sections 133L, 133R are coextensive with parallel laterally opposed, longitudinally disposed left and right sides of a longitudinally elongated, rectangular spine flap section 136. Spine flap section 136 has an inner laterally disposed base 137 and an outer laterally disposed straight edge 138, and serves as a protective cover flap for an outer surface of a first frame member in a finished corner protector 131, as shown in FIG. 26. As shown in FIG. 8, base edge 137 of central longitudinally disposed spine flap section 136 is a collinear laterally inwardly located extension of bases 134L, 134R of the left and right right-triangularly-shaped face-cover flap sections 123L, 123R. As shown in FIG. 8, each left and right right-triangularly-shaped face-cover panel section 133L, 133R has extending perpendicularly outwards from a laterally disposed base edge 134L, 134R a laterally elongated rectangularly-shaped frame-edge cover-flap section 139L, 139R, respectively.

Each frame-edge cover-flap section 139L, 1399R has a short longitudinally disposed outer edge 140L, 140R which extends perpendicularly outwards from the outer end of the base 134L, 134R of a right-triangularly-shaped face-cover flap section 133L, 133R, a longer outer laterally disposed edge 141L, 141R, which is parallel to base 134L, 134R and protrudes laterally inwardly from an outer end of outer edge 140L, 140R, and a short inner longitudinally disposed edge 142L, 142R which extends perpendicularly inwards from the inner end of outer laterally disposed edge 141L, 141R to the joint between the inner edge of the base 134L, 134R of the triangular face-cover flap section 133L, 133R and the inner end of the altitude 135L, 135R that forms the vertex 143L, 143R of the right angle of the triangular face-cover flap section. As shown in FIG. 8, the outer corner edges 144L, 144R of frame-edge cover flap sections 139L, 139R are preferably beveled.

As may be understood by referring to FIG. 26, in a finished corner protector 13, frame edge cover-flap sections 139L, 139R are folded and glued together in parallel relationship, and together form a protective cover for the outer surface of a second frame member.

Referring still to FIG. 8, it may be seen that each left and right panel section 132L, 132R of pre-form 37 has protruding laterally outwards from an obliquely disposed hypotenuse edge 145L, 145R thereof a smaller right-triangularly-shaped spring flap 146L, 146R. Each spring flap 146L, 146R, has the shape of a right triangle which is inverted with respect to right triangularly-shaped face-coverflap section 133L, 133R, and thus has a laterally disposed base edge 147L, 147R, a longitudinally disposed altitude edge 148L, 148R which depends perpendicularly from the outer edge of the base towards the base of triangular face-cover flap section 133L, 133R, and an obliquely disposed hypotenuse 149L, 149R which is coextensive with a segment of hypotenuse 145L, 145R of the triangular face-cover flap section 133L, 133R.

In a preferred embodiment, of corner protector pre-form 37, the width of spine flap section 136 and the height of frame-edge cover flap sections 139L, 139R are each equal to a common dimension which is slightly greater than the thickness of a typical picture frame, e.g., about 15/16 inch for a frame thickness of 1/8 inch. As shown in FIG. 8, pre-form 37 is preferably scored along both longitudinally disposed edges of central spine flap section 136, bases 134L, 134R of right-triangularly-shaped face-cover flap sections 133L, 133R, and hypotenuses 149L, 149R of right-triangular spring flap sections 146L, 146R. These score lines are located along junctions between adjacent cover-flap sections of a finished corner protector 131, and facilitate folding by machine 30 of the various cover flap sections out from the plane of a pre-form 37 and into the form of a finished corner protector 131, as will now be explained.

FIGS. 12-25 illustrate a method according to the present invention for automatically fabricating quantifies of corner protectors 131 from cardboard blanks or pre-forms 37.

The method according to the present invention includes the step of loading a vertically aligned stack of pre-forms 37 into loading magazine 36, resulting in the bottom pre-form in the stack dropping under the force of gravity through aperture 40 through guide plate 41 and into recess 44 below the guide plate.

A start switch (not shown) on control panel 248 is then turned on, thus applying electrical power to PLC 34, adhesive dispensing apparatus 236, and an air compressor (not shown) which supplies pressurized air to solenoid actuated valves in valve box 233 that are opened and closed by signals from PLC 34 to thus distribute pressurized air to the various pneumatic actuator cylinders of machine 30.

After an initialization time interval sufficient for the adhesive of hot-melt adhesive dispensing apparatus to be heated up to a molten state of a pre-determined viscosity, PLC 34 issues a command signal to a solenoid valve which supplies pressurized air to feeder mechanism actuator cylinder 55. As shown in FIGS. 12 and 13, retraction of piston rod 54 of feeder mechanism actuator cylinder 55 pulls slider plate 44 forward, thus pushing a corner protector pre-form 37 forward to folding station 46 on the upper surface 39 of base plate/work table 31, as shown in FIG. 13.

Next, as shown in FIG. 14, PLC issues a command signal that cause spine-flap hold-down bar 61 to slide rearwards over the upper facing, inner or reverse surface of spine flap 46 of pre-form 37 located at folding station 46.

With pre-form 37 retained in place at folding station 46, the following folding and adhesive bonding steps are performed to transform the pre-form 37 into a finished corner protector.

Figure 15:
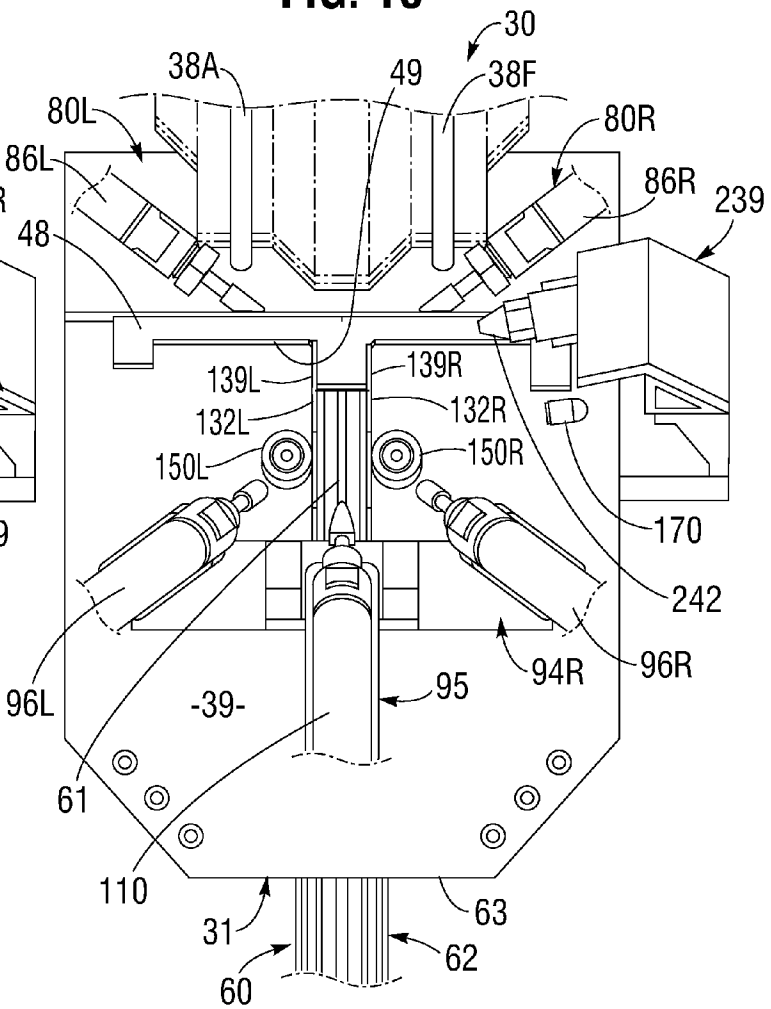
FIG. 15 is a view similar to that of FIG. 14, but showing left and right folder cylinders of the machine extended upwards from the work table to bend left and right flap sections of the corner protector into vertical positions.

First, as shown in FIG. 15, PLC 34 issues a command signal which causes forming cylinder actuator cylinders 152L, 152R to extend forming cylinders 151L, 151R upwardly from initial home positions in which the upper transverse end faces of the forming cylinders are below upper surface 39 of base plate/work table 31 to thus push upwardly against the downwardly facing obverse sides of left and right panel sections 132L, 132R of pre-form 37. As shown in FIG. 15, this upward pushing action causes the left and right panel sections 132L, 132R of pre-form 37 to be bent perpendicularly upwards from the plane of spine flap section 136 to parallel vertical, longitudinally disposed orientations between forming cylinders 151L, 151R and left and right vertical sides, respectively, of spine-flap hold-down bar 61

Figure 16:
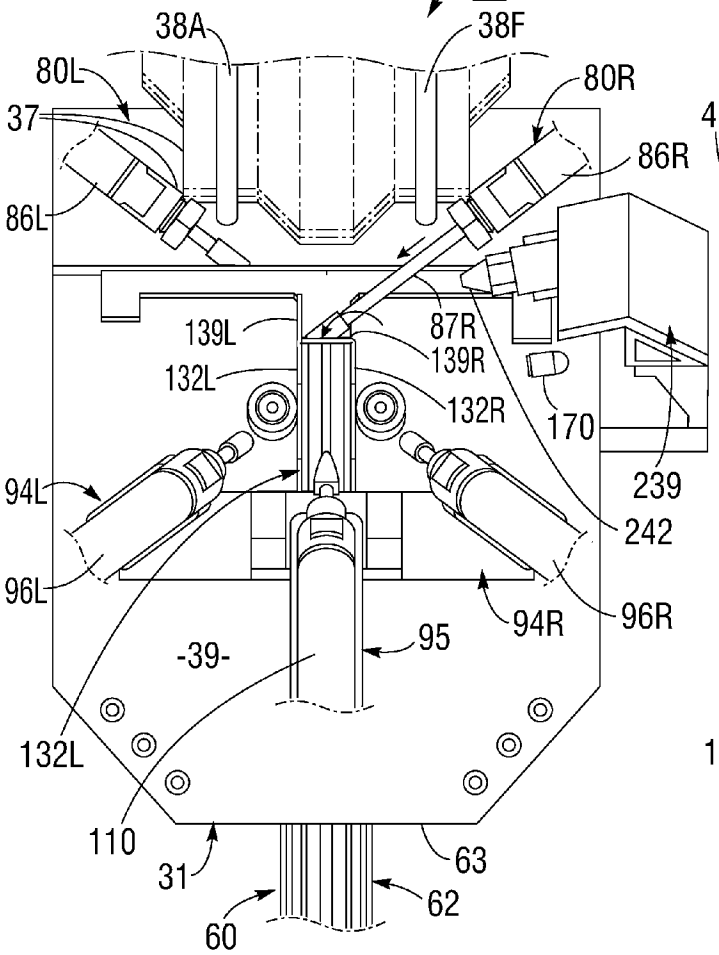
FIG. 16 is a view similar to FIG. 15, but showing a right rear folder wedge actuator rod of the machine extended obliquely forwards to fold a right-hand edge-cover flap section of the blank perpendicularly inwards from right-hand face-cover flap section of the blank

Second, as shown in FIG. 16, a first one of the originally horizontally disposed and now vertical frame-edge covers 139 of pre-form 37 is bent perpendicularly inwards, i.e., towards a longitudinally disposed vertical center plane through spine flap section 136, to an orientation perpendicular to left and right panel sections 132L, 132R.

In the mode of operation shown in FIG. 16, right-hand frame edge cover flap 139R is bent perpendicularly inwards from r right-hand vertical panel section 132. This bend is effected by the obliquely forward extensions of piston actuator rod 87R of right rear folder mechanism 80R to thus push forming shoe 89R against the outer, obverse side of right-hand frame-edge cover flap 139R. Actuator rod 87R is extended forward from pneumatic actuator cylinder 86R in response to a command signal issued by PLC 34.

Figure 17:
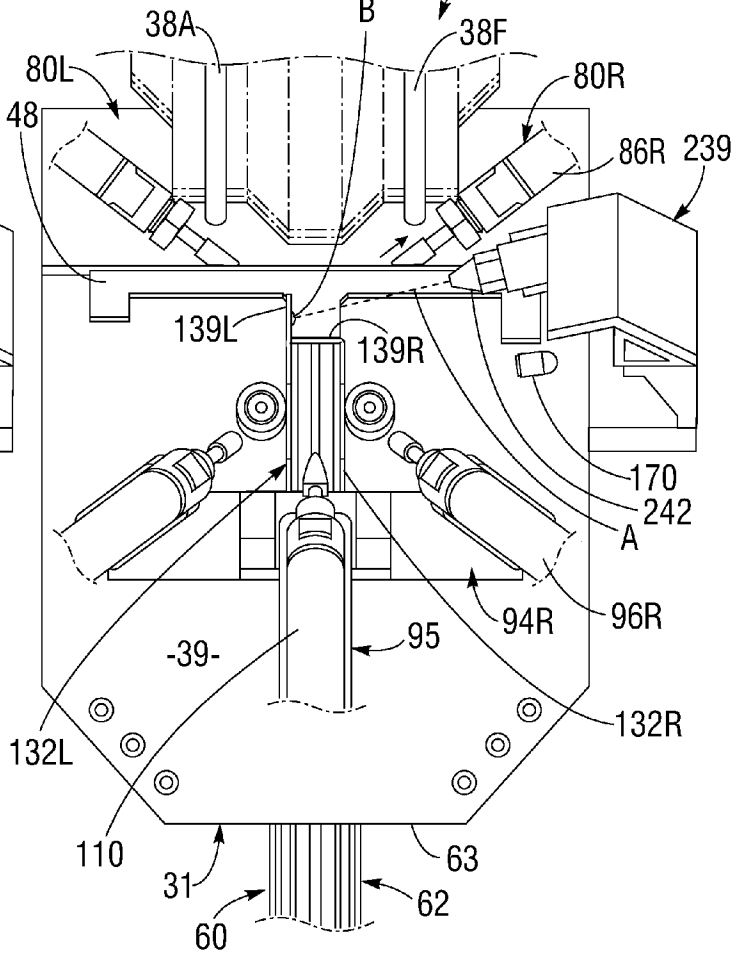
FIG. 17 is a view similar to that of FIG. 16, but showing a hot-melt glue gun nozzle spraying a dot of adhesive on the inside, corrugated surface of the left-hand edge-cover flap.
Figure 18:
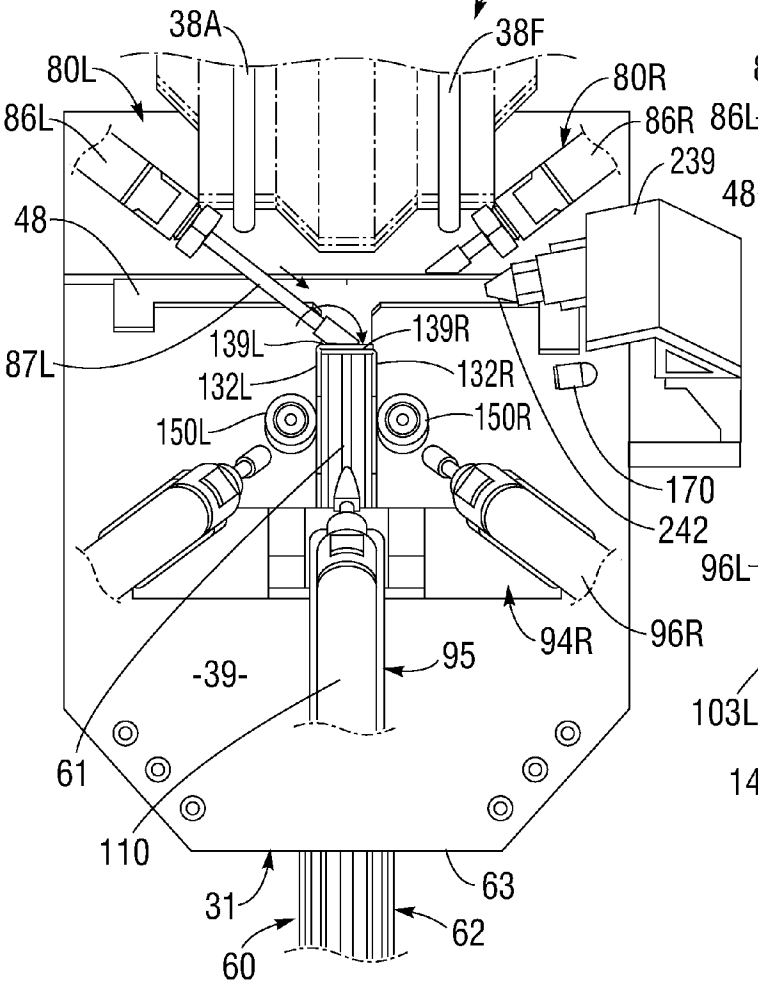
FIG. 18 is a view showing the left rear folder wedge actuator extended obliquely forwards to fold a left-hand edge-cover flap into parallel overlying contact with the right-hand edge-cover flap of the corner protector blank to thus press the inner surface of the left edge-coverflap into adhesively adhering contact with the outer surface of the right-hand edge-cover flap.

Referring to FIG. 17, it may be seen that piston rod 87R is retracted after bending frame-edge cover flap 139R. Then, as is also shown in FIG. 17, a jet of molten hot-melt adhesive is ejected from nozzle 242 of adhesive applicator head 239 to thus deposit a blob of glue B unto the inner, reverse side of left-hand frame-edge cover flap 139L Next, as shown in FIG. 18, PLC 34 issues a command signal which causes piston rod 87L of pneumatic cylinder 86L of left rear folder mechanism 80L to extend obliquely forwards towards work station 46, thus pushing forming shoe 89L at the forward end of the piston rod against the outer, obverse side of left-hand edge cover flap 139R, and thus bending the left-hand edge-cover flap perpendicularly inwards. This action causes the glue blob B on the inner, reverse side of the left-hand edge-cover flap 139R to be pressed into compressive contact with the outer, obverse side of the right-hand edge-cover flap 139R. Actuator 80L is maintained in an extended position for a short time interval which is sufficient for the hot-melt adhesive blob B to solidify and thus adhesively bond left-hand edge-cover flap 139L to right-hand edge-cover flap 139R, and is retracted at the end of this time interval.

Figure 19:
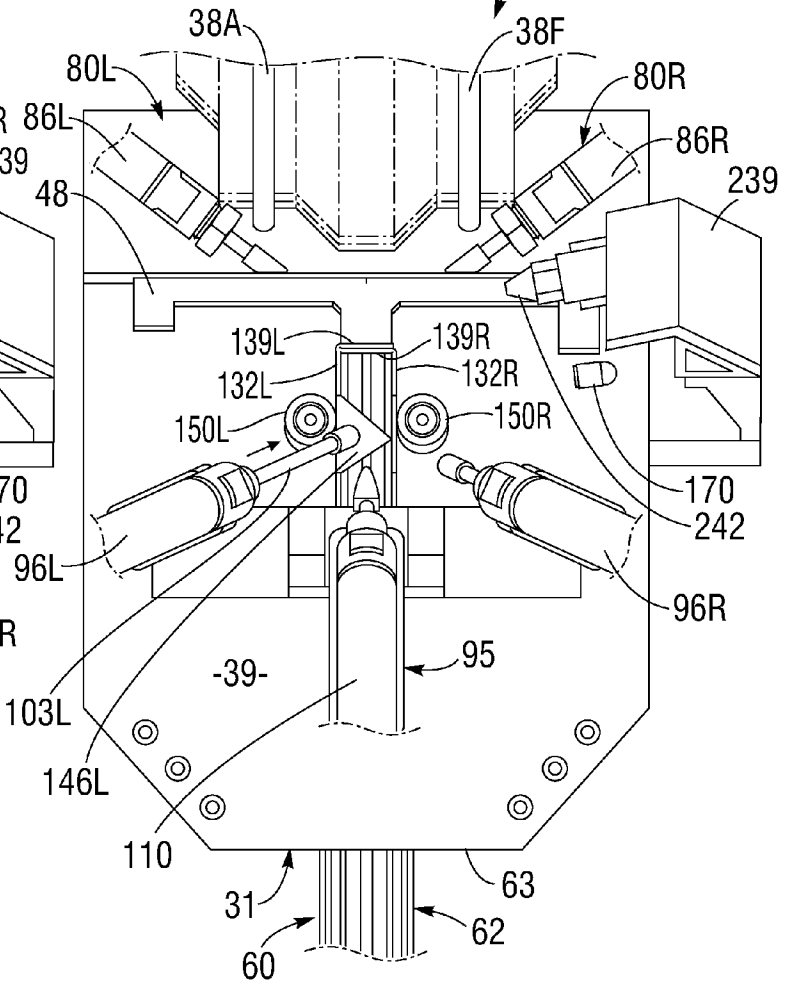
FIG. 19 is a view showing a left-hand slip-on retainer triangle spring flap being bent downwardly into place by a left front actuator rod

As shown in FIG. 19, the next step in fabricating a finished corner protector 131 from a pre-form 37 consists of bending a first one of the small, right-triangularly shaped spring flaps 146L, 146R inwardly from a vertically oriented triangular face-cover flap section 133L, 133R and downwardly between the vertically oriented inner facing, reverse sides of the face-cover flap sections.

In the operational mode shown in FIG. 19, left-hand spring flap 146L is first bent inwardly and downwardly in response to a command signal issued by PLC 34 which causes piston actuator rod 103L of pneumatic actuator cylinder 96L of left-front folder mechanism 94L to extend obliquely downwardly rearwardly and laterally inwardly to thus push the forming bumper 104L at the outer end of the actuator rod against the outer, obverse surface of left-hand spring flap 146L and thereby pushing the left-hand spring flap downwardly between left-hand vertical panel section 132L and right-hand vertical panel section 132R.

Figure 21A:
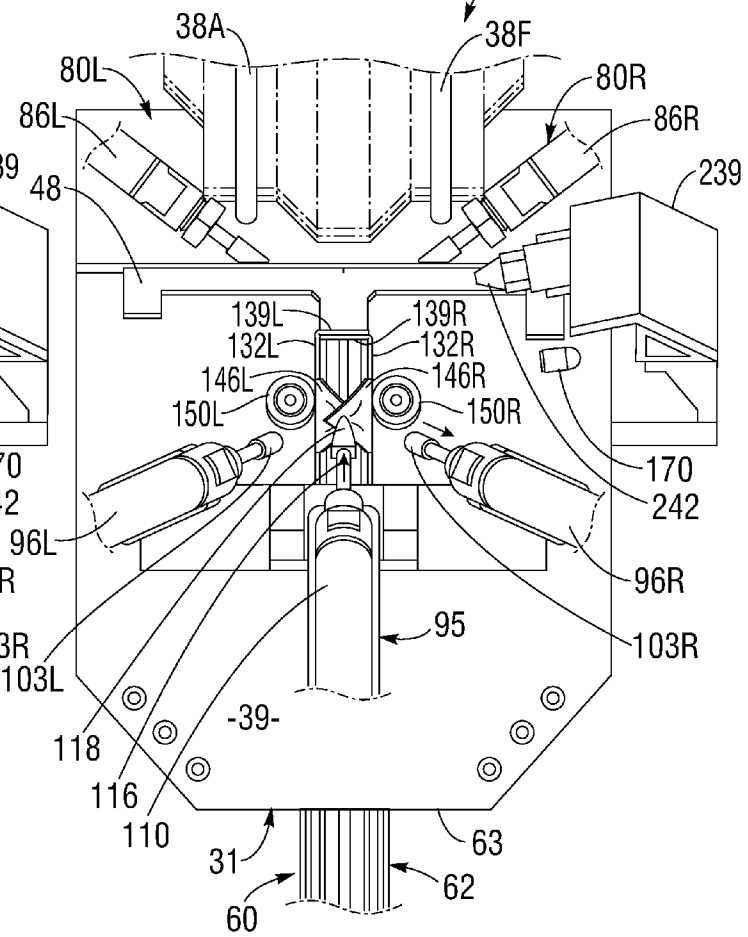
FIG. 21A is a view showing left and right bent retainer triangle spring flaps being pushed downwards into place by a center actuator rod.
Figure 20:
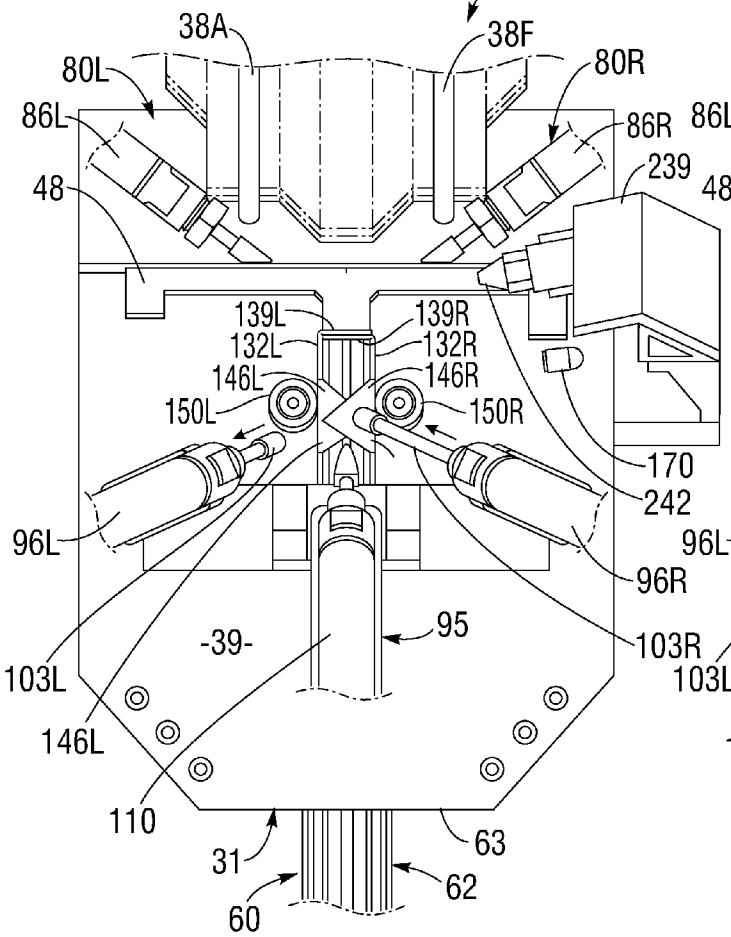
FIG. 20 is a view showing a right-hand slip-on retainer triangle spring flap being bent downwardly into place by a right front actuator rod.
Figure 22:
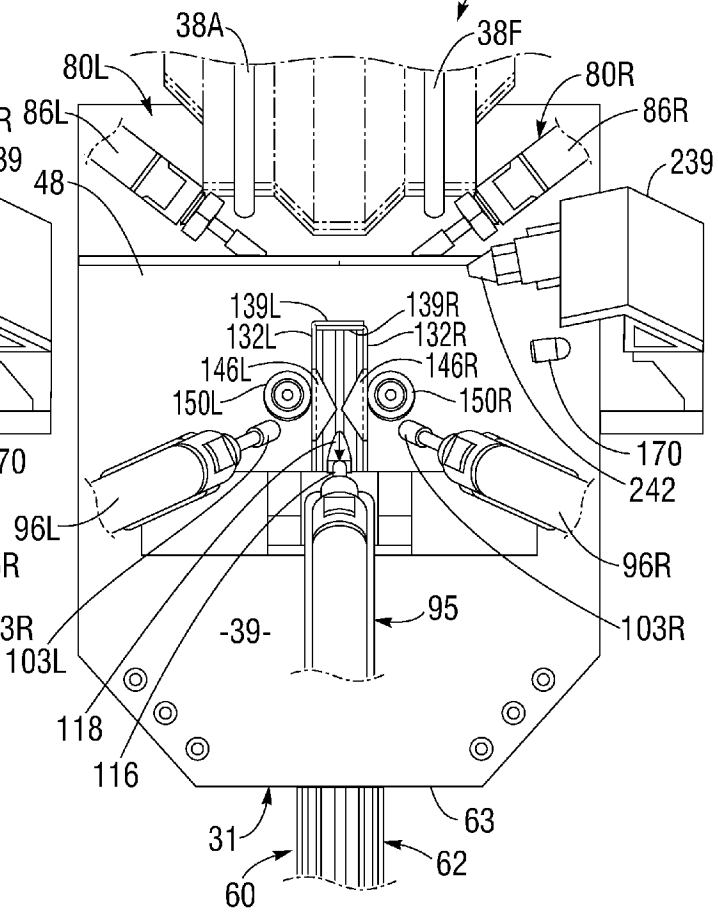
FIG. 22 is a view similar to that of FIG. 21, but showing the center actuator rod retracted fully forward and left and right folder cylinders moving downwards.
Figure 21B:
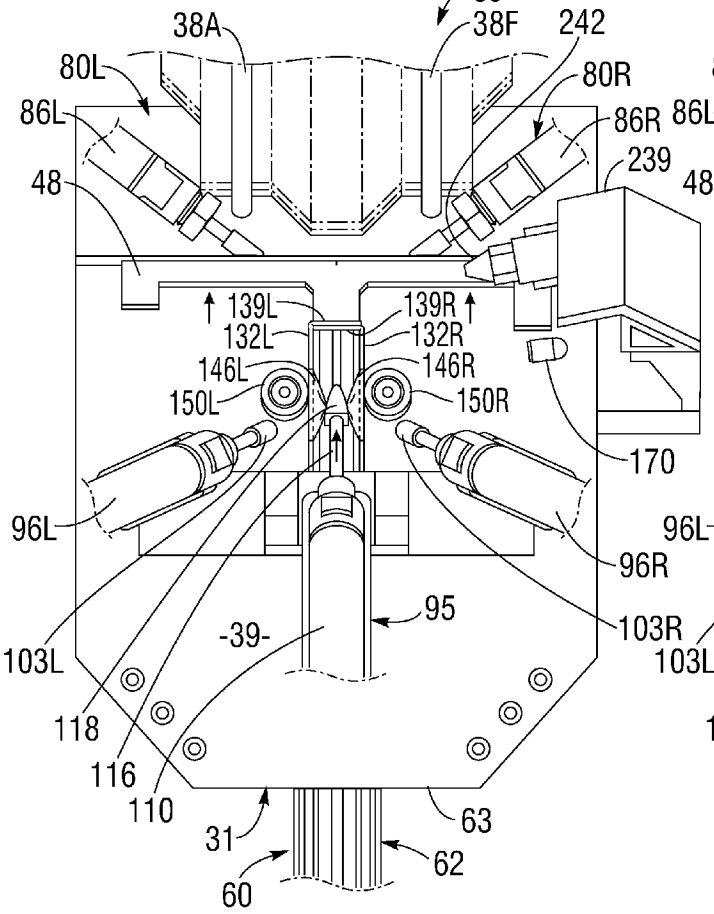
FIG. 21B is a view showing left and right bent retainer triangle spring flaps pushed fully downwards into place by a center actuator rod to finish fabrication of a corner protector.

Next, as shown in FIG. 20, actuator rod 103L is retracted, and actuator rod 103R of right-front folder mechanism 94R is extended to thus bend right-hand spring flap 146R downwards against the upper side of left-hand spring flap 146L Next, as shown in FIGS. 21A and 21B, PLC 34 issues a command signal which causes pneumatic actuator cylinder 110 of center folder mechanism 95 to extend actuator rod 116 obliquely downwardly and rearwardly to thus push the forming shoe 118 at outer end of the actuator rod against the inner facing corners of left and right spring flaps 146L, 146R sufficiently far for the spring flaps to press elastically inwardly against the shoe at the outer end of the piston rod and against one another when the actuator rod is retracted. As shown in FIG. 22, piston rod 116 is then retracted forward to a home position.

Figure 23:
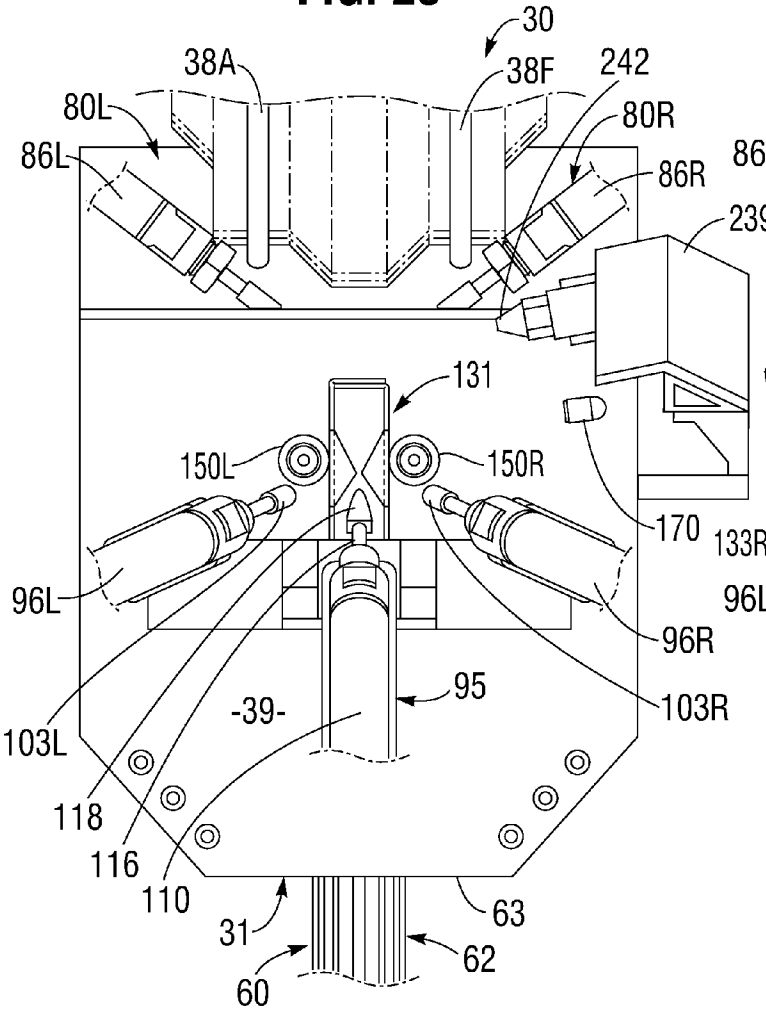
FIG. 23 is a view similar to that of FIG. 22, but showing left and right folder cylinders retracted fully downwards below the upper surface of the work table, and spinet holder bar retracted fully forward. and a view showing an air jet ejecting a fully formed corner protector off of the work table of the machine.

Next, as shown in FIG. 23, spine-flap hold-down bar 61 is retracted forward to a home position.

Figure 24:
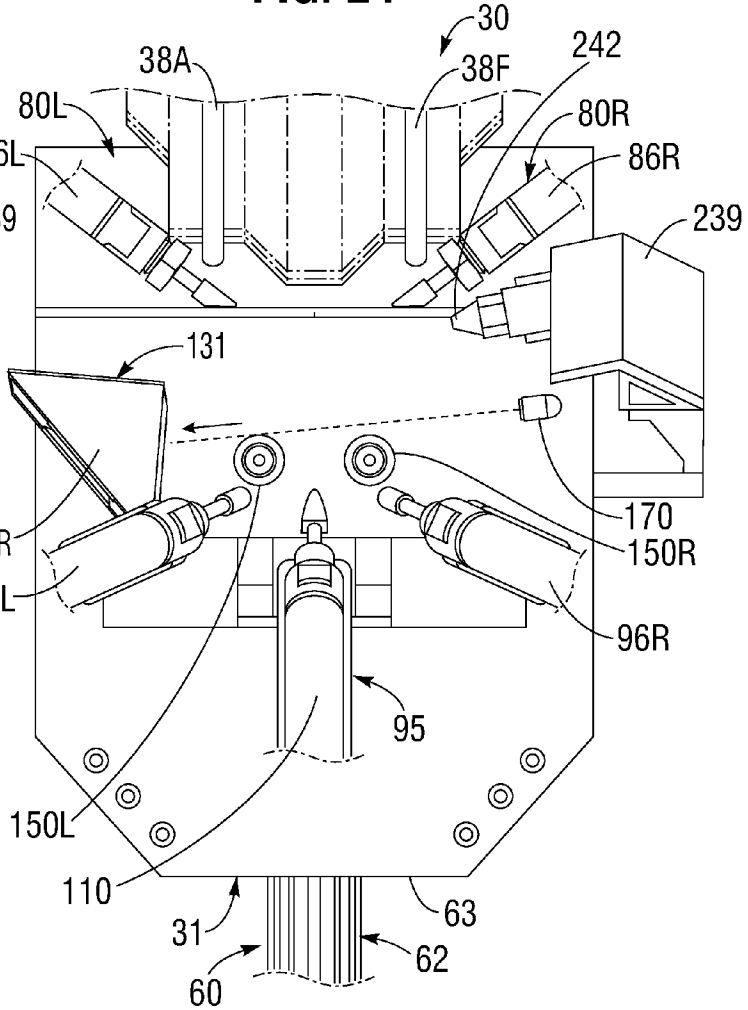
FIG. 24 is a view showing an air jet ejecting a fully formed corner protector off of the work table of the machine.

Finally, as shown in FIG. 24, a burst of air is issued from nozzle 170 in response to a command signal from PLC 34, and impacts a vertically oriented face-cover flap 133R of finished corner protector 131, thus propelling the finished corner protector off of the left hand edge of base plate/work table 31 to fall into a collection receptacle.

The foregoing sequence of steps to fabricate a finished corner protector 131 from a pre-form 37 may be cyclically repeated as long as magazine 36 holds a stack of pre-forms 131.

FIGS. 26 and 27 show how the right-angle corner of a picture frame F is insertable into the entrance opening 160 of a corner protector 131, thus flexing spring flaps 146R, 146L elastically apart, which thus exert elastic compressive forces on opposed front and rear sides of frame members G and H and thereby retain the corner protector attached to frame F.

What is claimed is:

1. A machine for manufacturing from pre-forms each comprising a thin sheet of flexible material which has a predetermined outline shape corner protectors for rectangularly-shaped frames, said machine comprising;

a. a work table which has a flat work surface, b. a first actuator for advancing a pre-form to a work station on said work surface of said work table, c. a second actuator for advancing a hold-down retainer bar over said pre-form, d. a pair of left and right, laterally opposed forming cylinders elevatable vertically underneath left and right sides of said pre-form by third and fourth actuators to thus bend vertically upwards left and right sections of said pre-form, e. a fifth, right rear oblique actuator for bending laterally inwardly between a rear vertical part of said right upright section of said pre-form, f. an adhesive applicator for applying an adhesive blob to one of a reverse side of a rear vertical part of said left upright section and an obverse side of said bent vertical rear part of said right upright section of said pre-form, g. a sixth, left rear oblique actuator for bending laterally rightward said rear vertical part of said left upright section of said pre-form and pressing said adhesive blob between obverse and reverse faces of said rear parts of said right and left upright section of said pre-form, h. a seventh, right front oblique actuator for bending laterally to the left and downwardly a right-had spring flap section from said right-hand upright section of said pre-form, i. an eighth, left front oblique actuator for bending laterally to the right and downwardly a left-hand spring flap section from said left-hand upright section of said pre-form, j. an ejector mechanism for ejecting from said work station a finished corner protector, and k. a pre-programmed controller for issuing control signals to said actuators to cyclically repeat steps defined in paragraphs (b) through (j).

2. The machine of claim 1 wherein said adhesive applicator is further defined as including a liquid adhesive nozzle spaced apart from said pre-form which is effective in spraying a blob of liquid adhesive onto said pre-form.

3. The machine of claim 1 wherein said ejector mechanism for ejecting a finished corner protector from said work station is further defined as including an air jet nozzle which is effective in directing an air jet against said finished pre-form to thus accelerate and propel said finished corner protector off of said work table.

4. The machine of claim 1 further defined as including a magazine for holding a stack of pre-forms.

5. The machine of claim 4 wherein said first actuator for advancing a pre-form to said work station is further defined as including a pusher plate located behind a rear surface of a pre-form in a stack in said magazine, said pusher plate being movable by said first linear actuator towards said work station.

6. The machine of claim 5 wherein said adhesive applicator is further defined as including a liquid adhesive nozzle spaced apart from said pre-form which is effective in spraying a blob of liquid adhesive onto said pre-form.

7. The machine of claim 6 wherein at least one of said actuators is further defined as being a linear actuator.

8. The machine of claim 7 wherein said linear actuator is further defined as including a pneumatic cylinder.

9. The machine of claim 1 further including a ninth, center front oblique actuator for pushing said left and right spring flaps in unison further downwards between inner facing sides of said left and right upright sections of said pre-forms.

10. The machine of claim 1, wherein said machine is configured to act upon a corner protector pre-form comprising;

i. a first, rear right-triangularly shaped rear frame face cover panel, ii. a second, front right-triangularly shaped front frame face cover panel, iii. a first, vertically disposed rectangularly shaped vertical frame edge cover panel, said vertical framed edge cover panel having parallel rear and front vertical edges which are coextensive with vertical sides of said rear and front right-triangulary shaped frame face cover panels, respectively, iv. a second, horizontally disposed rectangularly-shaped frame edge cover panel, said second frame edge cover panel having parallel rear and front horizontal edges which are coextensive with horizontal sides of said front and rear right-triangularly-shaped cover panels, respectively, v. said cover panels forming between innerfacing surfaces thereof a hollows prismatic shaped interior space having a right triangular plan-view shape having disposed transversely thereto a rectangularly-shaped entrance opening formed between an upper transversely disposed edge of said first vertically disposed frame edge cover flap, a lower transversely disposed edge of said second, horizontally disposed frame edge cover panel, a rear hypotenuse edge of said rear triangular frame face cover panel and a front hypotenuse edge of said front triangular frame face cover panel, and vi. at least a first spring flap which protrudes elastically into said interior space to thus exert a retaining force on a frame insertable into said entrance opening.

11. The machine of claim 10 wherein said first spring flap of said corner protector pre-form protrudes from one of said first and second triangular cover flaps.

12. The machine of claim 11 wherein said first spring flap of said corner protector pre-form is further defined as protruding from a hypotenuse edge of one of said first and second triangular cover flaps.

13. The machine of claim 12 wherein said first spring flap of said corner protector pre-form is further defined as being joined to said hypotenuse edge of said triangular cover flap by a self-hinge formed by a fold line made between a unitary piece of material comprising said triangular frame face cover panel and said spring flap.

14. The machine of claim 13 wherein said corner protector pre-form further includes a second spring flap which protrudes from a hypotenuse edge of a second of said first and second triangular frame face cover panels.

15. The machine of claim 14 wherein each of said first and second spring flaps of said corner protector pre-form has the shape of an isosceles triangle joined along its hypotenuse to the hypotenuse of a triangular frame face cover panel.

* * * * *